US006186469B1

(12) United States Patent
Scott

(10) Patent No.: US 6,186,469 B1
(45) **Date of Patent: *Feb. 13, 2001**

(54) UNIVERSAL CORNER FORM BRACKET

(75) Inventor: Samuel C. Scott, Aurora, CO (US)

(73) Assignee: Scott System Incorporated, Aurora, CO (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/064,228

(22) Filed: Apr. 23, 1998

Related U.S. Application Data

(63) Continuation-in-part of application No. 08/788,419, filed on Jan. 27, 1997, now Pat. No. 5,922,235, which is a continuation-in-part of application No. 08/510,006, filed on Aug. 1, 1995, now Pat. No. 5,667,190.

(51) Int. Cl.[7] ..... E04G 9/10
(52) U.S. Cl. ..... 249/16; 249/210
(58) Field of Search ..... 52/386, 387; 249/15, 249/16, 17, 219.1, 210, 85, 96, 83; 264/35

(56) References Cited

U.S. PATENT DOCUMENTS

| | | | |
|---|---|---|---|
| 2,005,030 | 6/1935 | Geisinger . | |
| 2,178,535 | 10/1939 | Willson . | |
| 2,825,221 | 3/1958 | Brouk . | |
| 3,131,514 | 5/1964 | Siek . | |
| 3,231,646 | 1/1966 | Conder et al. . | |
| 3,321,883 | 5/1967 | Pascucci . | |
| 3,496,694 | 2/1970 | Hicks et al. . | |
| 3,594,968 | 7/1971 | Johnson . | |
| 3,602,476 | 8/1971 | Iragorri . | |
| 3,694,533 | 9/1972 | Kelsey . | |
| 3,868,801 | 3/1975 | Weiner . | |
| 4,644,719 | 2/1987 | Salazar . | |
| 4,916,875 | 4/1990 | Kashiwagi . | |
| 4,947,600 | 8/1990 | Porter . | |
| 5,009,387 | 4/1991 | Scott et al. . | |
| 5,311,714 | 5/1994 | Passeno . | |
| 5,323,575 * | 6/1994 | Yeh | 52/386 |
| 5,418,036 * | 5/1995 | Yokikawa et al. | 52/386 |

* cited by examiner

*Primary Examiner*—Michael Safavi
(74) *Attorney, Agent, or Firm*—Pittenger & Smith, P.C

(57) ABSTRACT

A corner bracket for holding and securing objects to the surface of a construction form for embedding the object in a settable material, such as concrete, and exposing the face surface of the object in the finished construction, while forming a corner. The corner bracket comprises a plurality of perimeter members corresponding to the outer edge configuration of the object. Removable tabs are incorporated into perimeter members, and may be easily removed. Upon removal of the tabs, the perimeter members may fold around axial points to configure the bracket to fit around a corner. Flanged surfaces, extending inwardly from the perimeter members support the perimeter edges of the objects. Reinforcing crossmembers located subjacent to the fixed axial points on the perimeter members contain channels around which the crossmember and perimeter member may be folded. The cross section of the perimeter members can include a curved convex outer surface extending upwardly and outwardly from the flange to a flat surface perpendicular to the flange. The perimeter members form one half of a grout line mold formed in between adjacent objects embedded in the finished wall. The bracket also incorporates connecting tabs to connect a plurality of brackets together, thus providing the placement of objects around the corner of two adjoining surfaces to achieve the appearance of traditional masonry construction. The bracket may also be cut to a desired length to accommodate various sizes of objects. Adapter end pieces can be attached to complete the bracket. Hot glue may be used to secure the object to the bracket, and also to secure the bracket to the form.

19 Claims, 12 Drawing Sheets

Fig_1
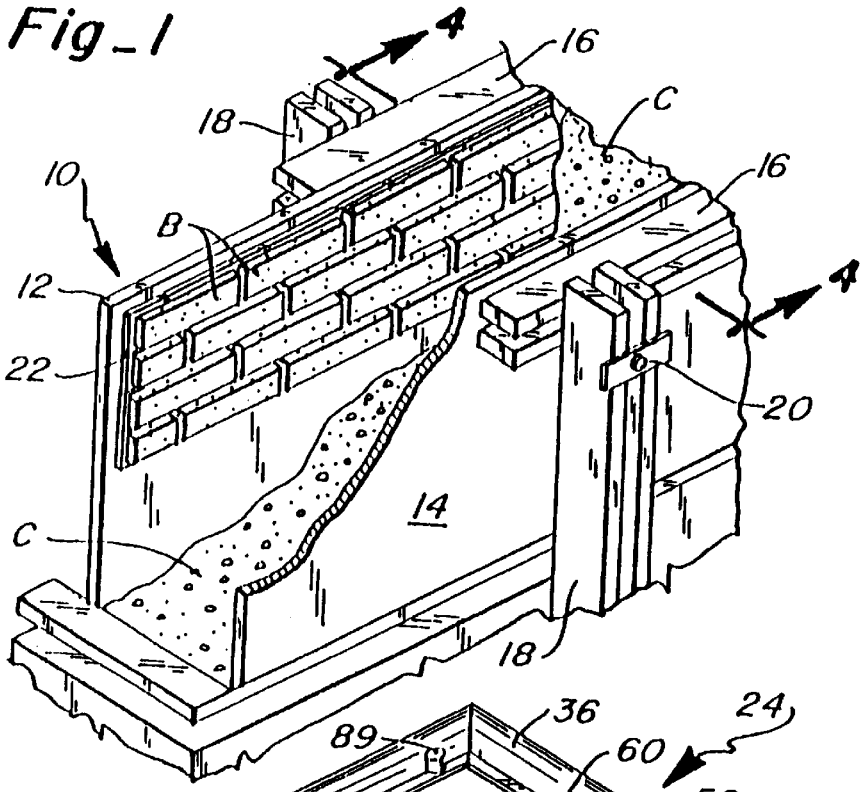
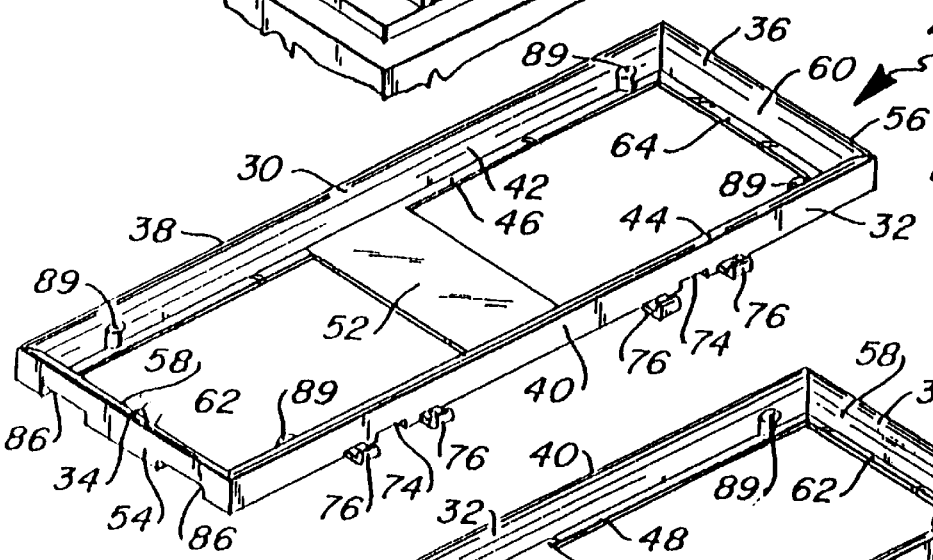
Fig_2
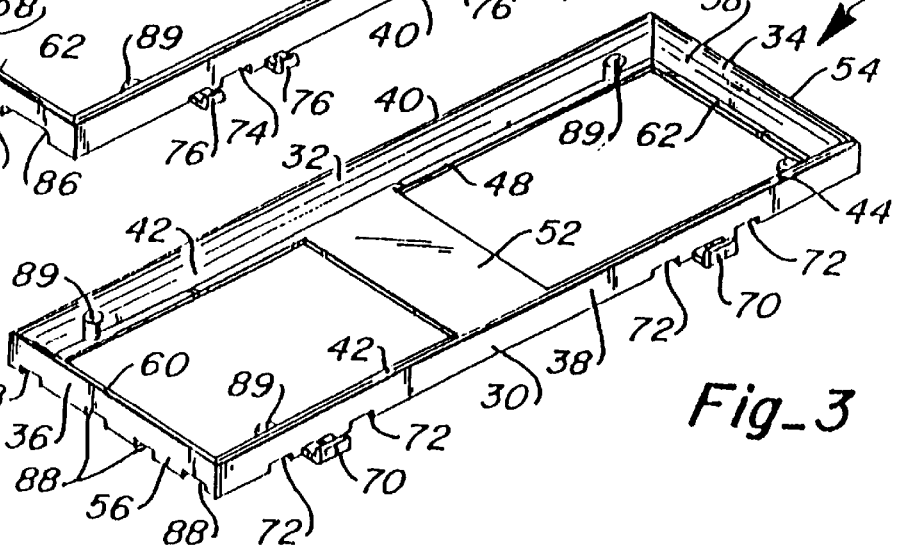
Fig_3

UNIVERSAL CORNER FORM BRACKET

This application is a Continuation-In-Part of Ser. No. 08/788,419 filed Jan. 27, 1997, now U.S. Pat. No. 5,922,235, issued Jul. 13, 1999 which is a Continuation-In-Part of Ser. No. 08/510,006 filed Aug. 1, 1995 now U.S. Pat. No. 5,667,190, issued Sep. 16, 1997.

FIELD OF THE INVENTION

This invention is directed to a bracket for retaining an object in position on the inside surface of a concrete form. It is more specifically directed to an interconnecting bracket properly positioned on the inside surface of a concrete form to hold at a corner an object which is embedded in the surface of a finished concrete structure. It is also directed to an arrangement for securing the bracket and object to the inside of the concrete form by use of a unique glue arrangement.

BACKGROUND OF THE INVENTION

Simulated brick construction in conjunction with concrete forming and fabrication of structures is becoming increasingly common in the construction of modem buildings. This is due to the fact that it is quite expensive to use the services of masons in order to build a conventional laid-up brick or masonry wall. With the shortage of skilled masons today, fabricating a conventional brick or masonry wall is costly and difficult. In order to avoid high costs and inconvenience, many construction companies have gone to the use of simulated brick building panels having concrete backing and position them as required to form a wall or structure having a simulated brick exterior appearance. A problem with this type of construction is that the panels are difficult to handle and position at the construction site.

Construction of this type of wall has improved recently by the use of brick or object retainers which are fastened directly to the inside surface of the concrete wall form. Concrete is poured into the form and flows around the back of the brick which is embedded in the outer surface of the structure. The problem with this type of construction is that many retainers fail and cause the bricks to fall to the bottom of the form cavity during the pouring process. Thus, a large void is left in the finished wall surface or concrete is exposed where the missing brick should be located. In addition, the panels and retainers which are currently used have been quite expensive and difficult to install. Most of these retainers require the bricks to be inserted into recesses within the panel or retainers within the form and therefore must be placed one at a time to cover the interior surface of the concrete form prior to pouring the concrete.

A different type of retainer is the liner or mat which is used in the horizontal position. These retainers are usually formed from elastomeric material and have recesses which closely fit the outside of the objects which are to be retained and position these objects in a desired pattern. The most common of these is the type which is fabricated for holding brick pavers and is designed to have the appearance of a conventional brick wall. This type of form and retainer is usually arranged in a horizontal position because it lacks the required support to securely hold the bricks or objects in position.

Another type of retainer used in vertical construction incorporates a mechanical structure attached to the inside surface of the concrete wall form and securely retains the brick or object in proper position during the pouring of the concrete.

However, none of the existing retainers can retain an object in a perpendicular relationship around a corner of a wall, thus creating the appearance of an exposed brick corner of conventional masonry construction. There is a need for a low-cost, disposable retainer which can position an "L" shaped object on a form to create the appearance of a corner or edge of a traditional masonry wall.

Another area which has become of major concern is how to hold the bracket and object in proper position on the form. Many methods have been used in the past, but have proven to be inadequate. This is especially true in relation to the use of steel wall forms or other rigid materials. With the use of brackets for retaining objects the brackets must be individual anchored to the form by nails, staples or other devices to adequately retain the bracket in position but still releasable to allow removal when the forming process is complete.

INFORMATION DISCLOSURE STATEMENT

The following section is provided in order to comply with the applicant's duty to disclose any known prior art related to the present invention.

The Johnson patent (U.S. Pat. No. 3,594,968) teaches a retainer comprising a plurality of frames and spacers which adheres to a wall to define spaced openings for the insertion of decorative blocks. The blocks are later positioned within the openings and adhesively secured to the finished wall structure. The present invention teaches a bracket or frame for retaining a pair of bricks or objects at an angle at edge of a form to create the appearance of a cornerstone. The bracket of the present invention, is temporary and may be removed or released with the form to expose the embedded bricks or objects.

The Siek patent (U.S. Pat. No. 3,131,514) discloses the construction of a thin precast wall panel. The small plate-shaped objects are affixed by cement to a sheet of paper or a web of fabric and then inserted into a mold. The mold is used to cast the wall panel with the objects embedded in the exposed surface of the panel. The molding is preformed in the horizontal position. However, there is no teaching in the Siek patent of a retainer for securing bricks or other objects to a form such that the bricks or other objects create the appearance of a cornerstone.

The Conder et al patent (U.S. Pat. No. 3,231,646) describes the use of an upright form arranged with one side mounted on a trolley and having a plurality of horizontally positioned flanges for supporting and spacing a plurality of bricks vertically along the inside surface of the form. A spring biased hook passes through the form and mechanically holds a brick in position. Clips can also be used to hold the bricks in position with the supporting flanges. This arrangement is far removed from the disposable bracket for holding objects in a perpendicular configuration as disclosed in the present invention.

The Hicks et al. patent (U.S. Pat. No. 3,496,694) discloses a flexible grid which is bonded directly to decorative members, such as molded brick or other shapes. The prefabricated grid and decorative members are attached to the frame of the building to provide a prefabricated artificial facing for the structure. The Hicks patent does not teach a disposable bracket for holding the objects in a perpendicular configuration. Furthermore, as taught by the Hicks patent, the grid member and decorative members are attached directly to the surface of the building and remain permanently attached. The present invention is directed to a bracket or frame which holds a pair of bricks or other objects in proper position on the inside surface of the wall form during the concrete pouring process but is removed after the concrete has set.

The Samuel C. Scott et al. patent (U.S. Pat. No. 5,009,387) discloses a form liner having a plurality of properly positioned recesses for the insertion and retention of brick pavers or other objects. Various retainers are disclosed which hold the objects in proper position against the inside surface of the vertical concrete wall form while the concrete is poured. The form liner is removed with the form and a portion of the retainer, in most cases, remains within the concrete after the form has been removed. Some of the form recesses may include tabs or extensions on opposite sides of the recess to hold the object in position during the concrete pouring process. However, the present invention is directed toward creating the appearance of a cornerstone, as well as a removable, disposable retaining bracket.

The Salazar patent (U.S. Pat. No. 4,644,719) discloses a decorative wall panel which includes a patterned top layer which is formed from a slow-cured molded mixture of Portland Cement, sand and pigmented binder. There is no teaching in the Salazar patent of placing the mold on the inside surface of a concrete form or create the appearance of a cornerstone.

The Brouk patent (U.S. Pat. No. 2,825,221) discloses a thin brick embedded panel which is poured in a horizontal form. The bricks are merely positioned within a tray or mold and a thin concrete mixture is then poured over the backs of the bricks to embed the bricks in the surface of the concrete panel. This type of construction is relatively common. There is no teaching in the Brouk patent of configuring objects inside a concrete form to create the appearance of a cornerstone.

The publication, "Ceramic Tile Installation Methods Practiced in Japan", publication date unknown, discloses many different ways of installing tile for exterior decorative finishes. Various methods, such as precast concrete panel methods and fabricated form methods are disclosed in this publication. Many of these methods are those which are already shown and disclosed in various patents which have issued in the United States. It is believed that this publication does not disclose the use of brackets for holding individual bricks or objects within a wall form during the pouring of a concrete wall structure.

The Willson patent (U.S. Pat. No. 2,178,535) discloses the use of individual strips of resilient material which are attached to the inside surface of the concrete wall form which is used to hold and support the bricks or objects along the inside surface of the form prior to pouring the concrete. Again, this does not disclose the use of brackets for holding the individual bricks or objects along the surface of a form.

The Porter patent (U.S. Pat. No. 4,947,600) shows a precast concrete wall structure which is provided along the outside surface with a plurality of spaced linear parallel slots. The slots are formed by L-shaped angles which are mounted and attached to the wall and extend the length of a plastic base sheet. Grout is applied over the entire surface of the wall and support/spacer strips are inserted into each of the slots. However, there is no teaching in the Porter patent of retaining brackets that may configure objects around a corner of a wall, nor are individual retaining brackets disclosed in the Porter patent.

The Iragorri patent (U.S. Pat. No. 3,602,476) shows an elastomeric template having a plurality of patterned recesses which are formed on the bottom surface of a horizontal mold. Individual bricks are positioned within the recesses and concrete is then poured over the template and bricks. In this way, a brick facing concrete panel for construction purposes is fabricated. The template in this patent is merely included to properly position and space the individual bricks during the pouring process. There is no disclosure in the Iragorri patent of an individual interconnecting bracket that configures objects around the corner of a wall.

The Weiner patent (U.S. Pat. No. 3,868,801) discloses a building panel composed of masonry objects, such as bricks, synthetic polyester mortar, reinforcing wire mesh and a polymer foam to produce an interfacing layer. This sandwich type construction is held together by the foam mortar. The panel is formed by properly positioning the bricks in the desired arrangement, joining the bricks by applying polyester mortar to the backside of the bricks and between the adjacent bricks, applying reinforcing wire mesh within the mortar and then introducing a foam polymer which is cured in the space between the wire mesh and polyester and the outer facing layer. A composite panel structure is formed which can be mounted on the outer surface of a building or structure. The fabricated product which is disclosed in the Weiner patent is intended to be formed horizontally while the present invention can be formed in any angle. Furthermore, the Weiner patent does not teach configuring objects around a corner of a wall to create the appearance of a cornerstone.

The Geisinger patent (U.S. Pat. No. 2,005,030), Pascucci patent (U.S. Pat. No. 3,321,883), Kashiwagi patent (U.S. Pat. No. 4,916,875) and Passeno patent (U.S. Pat. No. 5,311,714) all show various types of brick or tile veneer construction which utilize various types of mass brackets which are attached directly to the outside surface of the building or structure. Various arrangements are shown for attaching the brackets directly to the surface of the structure and these, in turn, retain and hold a multitude of bricks or objects firmly against the outside surface of the structure. The joints between the bricks are filled with mortar or grout to represent masonry construction. None of these patents show individual brackets which retain individual bricks or other objects directly to the inside surface of concrete wall forms so that the objects themselves will be embedded in the finished surface of the concrete when the form and bracket are stripped from the form.

The Kelsey patent (U.S. Pat. No. 3,694,533) shows an arrangement for holding bricks or pavers on the inside surface of a concrete form by means of a vacuum retaining system. The vacuum holds the bricks and objects in proper position on the inside surface of the form while concrete is poured and sets to retain the bricks in the surface. Although the vacuum system is removed with the form, there is no disclosure of individual brackets for retaining and holding the bricks in position. The present invention is considerably cheaper and easier to operate than that shown in this prior art.

SUMMARY OF THE INVENTION

The present invention is directed to an apparatus and method of securing bricks or other objects to a concrete form around the corner of a wall to create the appearance of a corner or cornerstone in a conventional masonry wall. A bracket having a central recessed area is provided which is formed from a suitable metal, wood, plastic, plaster, synthetic resin or frangible material. The bracket has internal flanges and may include mechanical retaining features in conjunction with the recessed area which are used to secure an individual brick, brick paver or other object. Various types of adhesives which are suitable for retaining the brick or object in a proper relationship to the recessed area of the bracket can be used, if desired, to hold the object in the bracket recess during handling, forming or pouring of a castable material, such as concrete, plaster, plastic, or plastic foam. The bracket may be attached to the form by staples, tacks, or other fasteners, or hot glue or other water or solvent soluble adhesives. The bracket secures a first brick paver or other object to a wall while an attached portion of the bracket, upon removal of prescored tabs, hinges at the end of the brick paver or other object so as to form a corner. This hinged bracket, provides a secure, interlockable mechanism for securing an "L" shaped brick paver or a second brick paver or other object in a desired relationship around the corner of the wall. The bracket may also be used to attach an object that is shaped to fit around a corner, such as a stone or tile.

Removable inserts may be located at opposing positions along parallel side members to allow the bracket to hinge when the inserts are removed. The inserts may be prescored to allow removal by the use of commonly available tools such as pliers, but are sufficiently attached so that they will not inadvertently dislocate under normal bracket use.

Cross members spanning the central portion of the bracket between two opposing removable inserts may also be provided. Each cross member may be prescored with a groove along its center to facilitate a hinge along the groove while providing support for the bracket. The cross members may be located at opposing positions along the length of the bracket to allow the bracket to be positioned around either the left edge or the right edge of the form, thus forming either a left corner or a right corner.

Upon removal of the form from the poured concrete structure, the brackets can be easily removed from the bricks or objects which remain partially embedded in the surface of the wall. Depending upon the type of adhesive, if adhesives are used, water or solvent can be inserted between the form, bracket and the wall to dissolve the conventional adhesives used to hold the bricks or objects within the individual brackets. If a low heat release adhesive is used, it is possible that the heat generated by the concrete during the curing process could neutralize the adhesive so that the bracket is free from the object when the form is removed. Thus, the entire bracket is removed from the face of the finished wall structure. The brackets may be broken or destroyed at the time of removal and are primarily intended to be an inexpensive, one time use device. Alternatively, the brackets may also be fashioned from high strength materials which allows them to be reused.

Throughout this application reference is made to using adhesives to hold the brick or object in the bracket during the pouring of the settable material, such as concrete. It has been found that this same function can be successfully accomplished by using a "hot melt" glue gun which is readily available. By depositing a small dab of glue in several places around the flange of the bracket, a brick or object can be suitable retained within the bracket. However, when the form and bracket is removed, the spots of glue are small enough that the bracket separates cleanly from the object. It is possible to use the glue gun to mount the bracket directly on the inside surface of the form. This also permits the bracket to be cleanly separated from the form facilitating clean up of the wall as well as the forms.

The above and other objects, advantages and features of the present invention will become apparent when the following detailed description of the preferred embodiment of the present invention is considered in conjunction with the accompanying drawings.

DESCRIPTION OF THE DRAWINGS

FIG. 1 is a partial cut-away view showing a plurality of retaining brackets and bricks positioned on the inside surface of a concrete form which can be in a vertical, tilted, or horizontal position;

FIG. 2 is perspective view of an individual bracket according to the present invention;

FIG. 3 is a reverse view of the bracket shown in FIG. 2;

DETAILED DESCRIPTION OF THE INVENTION

Figure 4:
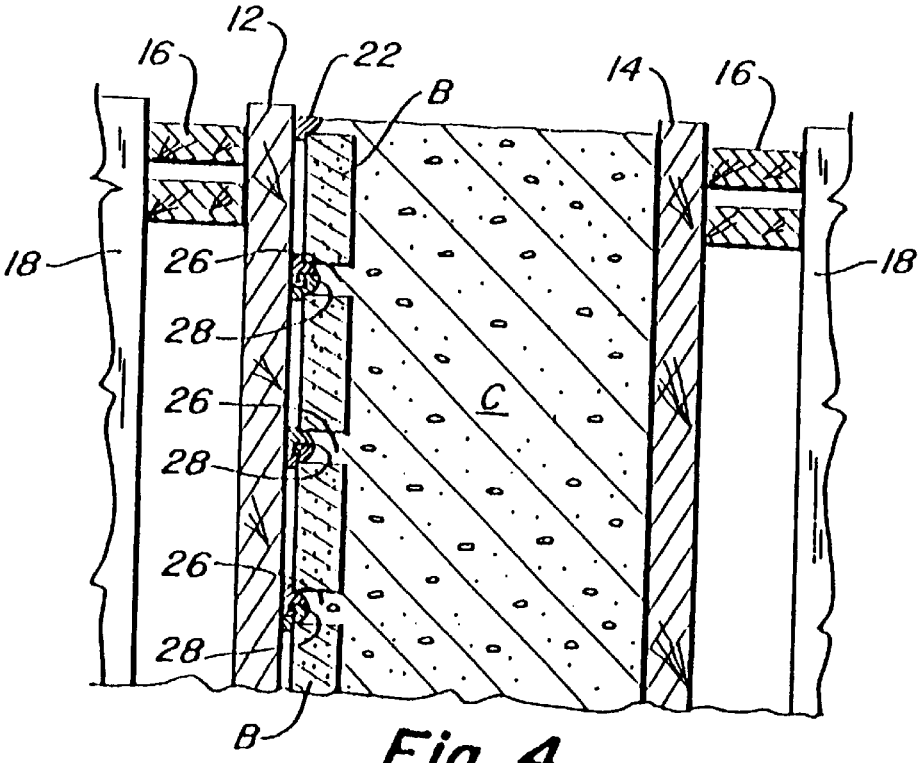
FIG. 4 is a partial cut-away view taken along lines 4—4 of FIG. 1.
Figure 5:
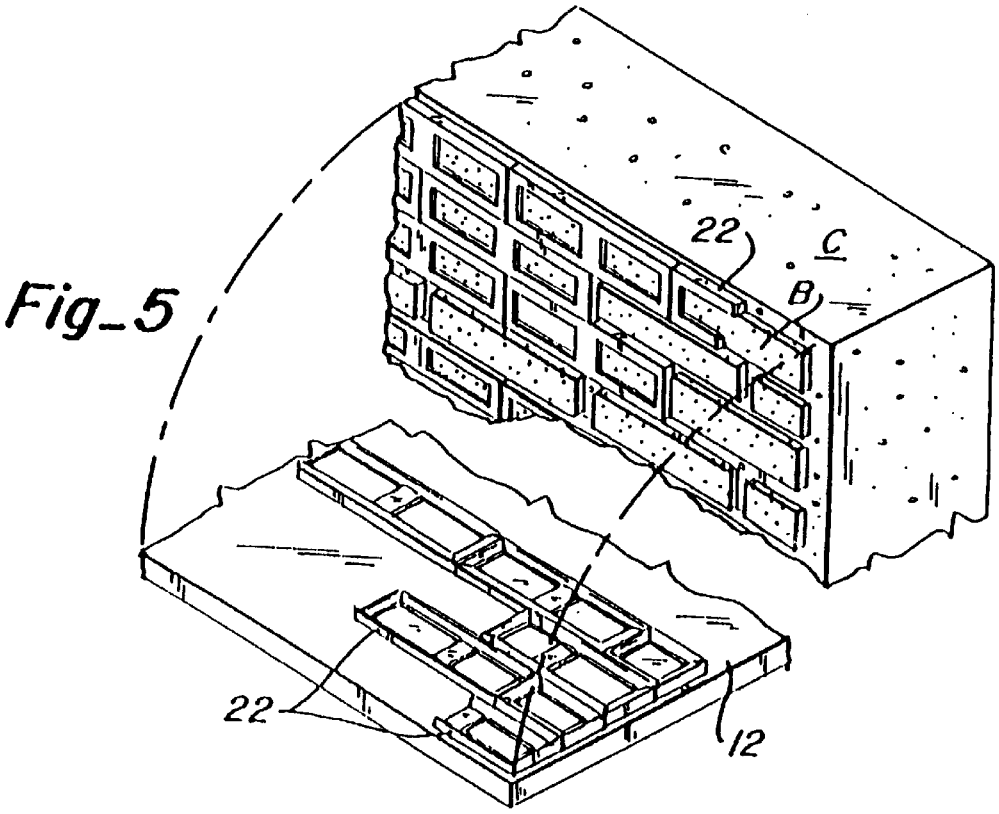
FIG. 5 is a partial perspective view showing the removal of the form from the surface of the concrete structure.

Directing attention to the drawings, FIG. 1 shows a partial cut-away view of a form which is used to construct a concrete wall structure. As shown in FIG. 1, the brackets may be used in a vertical or upright orientation. It is to be understood, however, that the brackets as described and claimed herein may be used in any form orientation or position such as horizontal, vertical, or tilted.

The vertical form 10 which is used to contain the concrete C while it is setting includes side forms 12, 14, horizontal whalers 16 and vertical ribs 18. Cross-ties 20 are used to hold the vertical side forms 12, 14 at a precise spacing distance to maintain a constant thickness in the finished wall structure.

A plurality of interconnected object retaining brackets or assemblage 22 is secured to the inside surface of the wall form 12. The assemblage 22 is made up of a plurality of individual brackets 24 shown in FIGS. 2 and 3. The individual interconnected brackets secure objects, such as brick pavers B, within the brackets. The brackets are provided with tabs and slots so that any design may be formed when the brackets are assembled or fastened together in the desired pattern and size. Usually the brackets 24 are arranged to form an assemblage 22 having a convenient size, such as two feet by four feet, which corresponds with the dimensions of the inside surface of the form 12.

As illustrated in FIG. 1, the assemblage 22 of brackets 24 is attached to the inside surface of only one side of the form. It is also understood that if objects are to be embedded in both surfaces of the structure then a similar amount of brackets 24 may be assembled and attached to the opposite surface of the form.

The assemblage 12 of individual brackets 24 is attached to the surface of the form 12 usually by staples straddling the two edges of the adjacent brackets 24. It is also feasible to use finishing nails driven through the raised edges of the brackets 24 or as an alternative the brackets may be secured to the surface of the form 12 by means of a suitable adhesive or other attaching device.

As can be seen in FIGS. 1 and 4, the concrete C is poured within the cavity formed by the outer form 12 and inner form 14. The poured concrete C fills the spaces 26 along the sides of the bricks B. In this way the concrete permanently secures the bricks to the surface of the wall structure. The brackets 24 making up the assemblage 22 may be used in vertical wall construction, but it is also to be understood that the same devices may be used in horizontal or tilt-up construction, if desired. The main advantage of the present invention is the fact that the objects may be custom arranged as desired and securely retained and held against the inside surface of the concrete form during wall construction or against the inside surface of a concrete form at any angle. This is a secure and reliable way of retaining the objects in proper position and secured against the surface of the form during the pouring of the concrete.

Extended surfaces of the perimeter members of the brackets 24 which can be curved when assembled act as a template or mold and create a concave surface 28 in the finished concrete filling the space 26 between the adjacent objects. This provides a concave grout line appearance between the objects which provides a natural masonry construction appearance. As a design choice, if a rake joint is desired, the top surface of the perimeter members 148 is formed flat, thus forming a rectangular molded grout line surface (see FIGS. 14–15). Other grout line configurations may be selected with an appropriate change in the cross-section of the perimeter surface.

Once the concrete C has properly set, the form support framework including whalers 16, vertical ribs 18, and vertical forms 12 and 14 are removed from the concrete structure. In this way, the surface of the concrete containing the embedded bricks or objects is exposed. In many cases, the assemblage 22 may be stripped away from the brick facing and remain attached to the outer form 12. However, in some cases the individual brackets 24 will break apart possibly leaving some portions attached to the brick and concrete material. Depending upon the type of adhesive which is used to secure the brick B to the surface of the bracket 24, such as water or solvent soluble or heat affected, it is a simple matter to either wash the outer surface of the structure to dissolve the remaining adhesive or to use a hot water spray which will melt and/or dissolve the adhesive if it is a temperature melt type. In any case, the brackets are stripped from the face of the concrete structure leaving a simulated masonry surface with the bricks relatively clean or requiring only a minimal amount of additional washing. In this way, the final labor costs may be greatly reduced due to the reduced cleaning requirements.

For the sake of illustration, the individual bracket 24 described herein is sized and intended for retaining a brick paver. As is commonly known, a brick paver is an object having the side dimensions of a standard brick but is only approximately one half to five eighths of an inch thick. It is primarily intended for use in lining walkways and is similar to a ceramic tile. The brick paver provides a simulated brick facing similar to masonry construction when embedded in the surface of concrete walls. The material which is used to fabricate the brick paver is standard fired clay masonry material.

As shown in FIGS. 2 and 3, the retainer bracket 24 is composed of side perimeter members 30 and 32 and end perimeter members 34 and 36. The difference in the views shown in FIG. 2 and 3 is that the bracket in FIG. 3 is reversed approximately 180° from the position shown in FIG. 2.

The outside mating surfaces 38 and 40, respectively, of the side members 30 and 32 are flat while the inside extended surfaces 42 and 44, respectively, of the side members 30 and 32 are curved to form a concave cross-section from the flat outer surfaces 38 and 40 to a narrow flange surface 46 and 48. For the alternative joints of a V-tool joint, a square rake joint, or any other joint shape, the corresponding mold shape is made by the selection of the shape of the perimeter top surface. The outside surface 38 of the side member 30 and curved front surface 42 have relatively constant thickness forming a cavity or slot 50 within the side member 30. Although it is possible to make the side member 30 a solid piece, it is desirable to include the cavity 48 in the construction to provide resilience and flexure between the outer surface 38 and curved inner surface 42. This flexure can accommodate variations in the outer dimensions of the brick pavers which can vary substantially due to the tolerances allowed for this type of product.

The flange surfaces 46, 48 may be connected by a crossmember 52 which adds rigidity to the overall bracket structure 24. The overall basic structure of the side member 32 is identical to the side member 30. By the same token the end members 34, 36 also have the same cross-section configuration which is formed by outer surfaces 54, 56 and inner curved surfaces 58, 60. Flange surfaces 62, 64, respectively, are also provided and are substantially perpendicular to the outer flat surfaces of the member.

The outer surface 38 of side member 30 includes a pair of outwardly extending tabs 70 which are each flanked on both sides by a pair of slots 72. In the same way, the outer surface 40 of side member 32 includes a pair of relatively wide slots 74 which are each flanked on both sides by outwardly extending tabs 76. The tab 70 includes a sloped face 78 and a raised ridge or catch 80. The spacing between the raised ridge 80 and the flat surface 38 of the side member 30 is arranged to accommodate the thickness of the associated side surface of the mating bracket. In the same way, each of the tabs 76 include a slanted outer surface 82 and a raised ridge 84. The sloped faces 82 and 78 are provided to accommodate the snapping together and connection of the bracket members 24.

Figure 6:
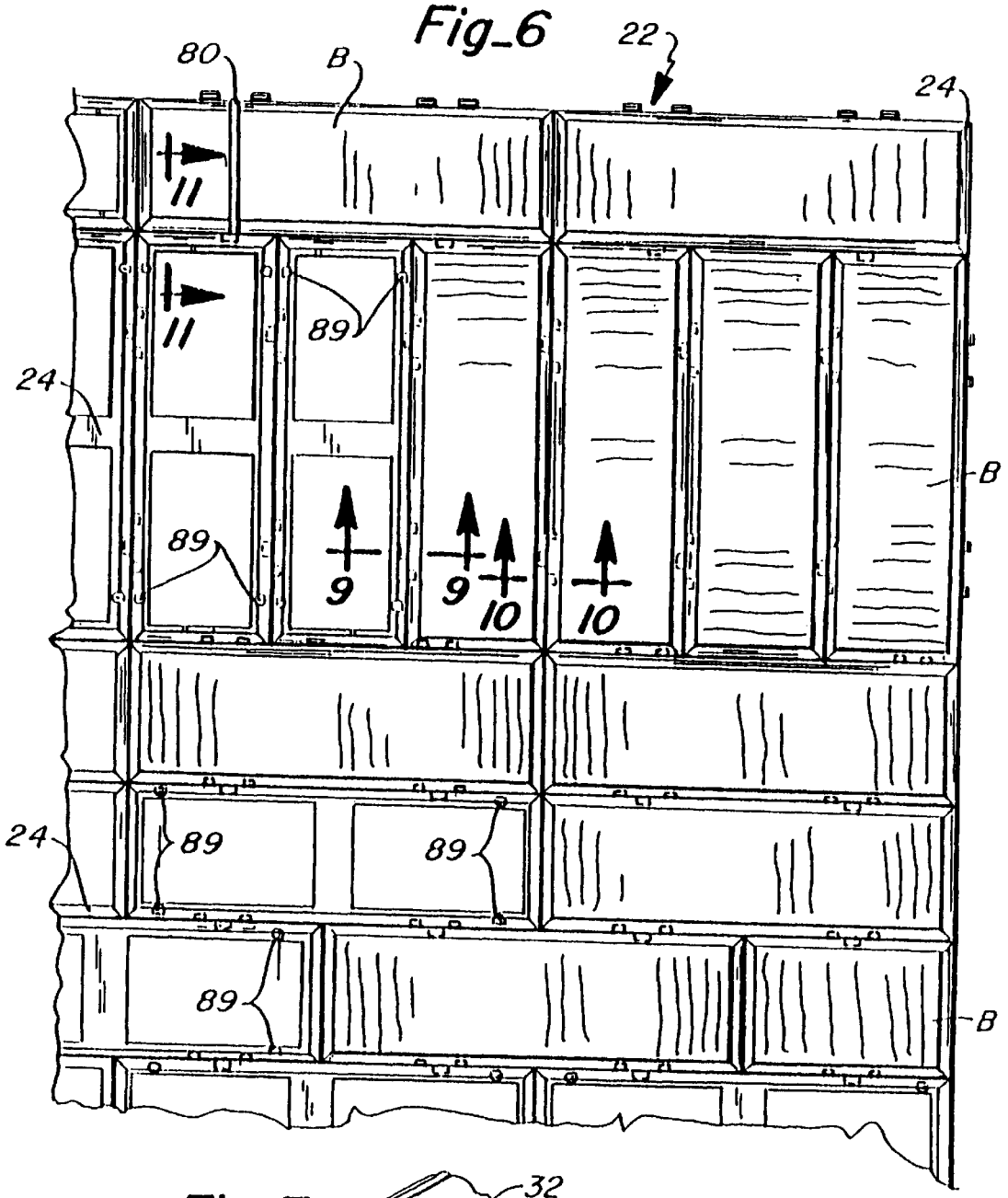
FIG. 6 is a partial elevation view showing the positioning of a plurality of retainer brackets and bricks showing a distinct pattern design that is capable with the present invention.
Figure 7:
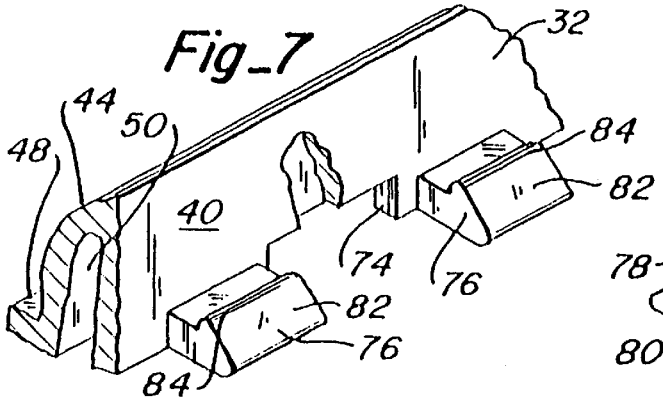
FIG. 7 is a partial cross-section view of one edge of a retainer bracket.
Figure 8:
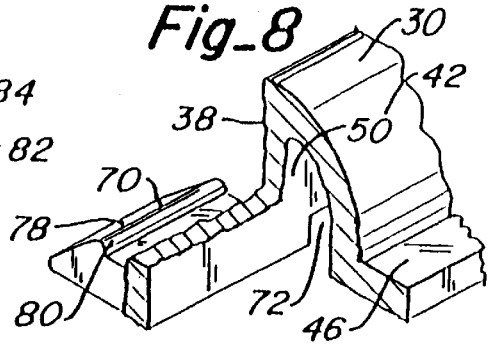
FIG. 8 is a partial cross-section view of the opposite side of the retaining bracket edge shown in FIG. 7.

As shown in FIGS. 2 and 3, the slot 74 provided in the outer surface 40 of the side member 32 is sized to fit the outwardly extending tab 70 provided on the outer surface 38 of the side member 30. Thus, the tab 70 will easily slide into the slot 74. In the same way, the pair of outwardly extending tabs 76 on the outer surface 40 of the side member 32 are spacedly positioned to mate with the position of the slots 72 provided in the outer surface 38 of the side member 30. To simulate standard masonry type construction usually the adjacent brackets 24 will be staggered so that half of one bracket is in juxtaposition to half of the adjacent bracket. Thus, one of the tabs 70 and a pair of slots 72 connects with one slot 74 and pair of tabs 76 on the adjacent bracket. This is illustrated in the lower portion of FIG. 6.

The end member 34 includes a pair of slots 86 which are sized and positioned to accommodate the tabs 70 on flat surface 38 of side member 30. In a similar fashion the flat surface 56 on end member 36 includes two pairs of slots 88 which are sized and spaced to accommodate the tabs 76 on the flat side surface 40 of side member 32. These slots are provided to accommodate the outwardly extending tabs on the side members when the brackets are set with an end adjacent the sides of other brackets for a decorative pattern change as shown in the upper portion of FIG. 6. Normally no outwardly extending tabs will be provided on the outer surfaces of the end members 34, 36. It is obvious that if tabs were provided then the ends could not slide together when the sides of the brackets are interconnected. It is to be understood, however, that tabs could be added to the end members 34, 36, if an accommodation is made in the adjoining bracket to allow the tab to slide into place during the interconnection of the side members.

It should also be considered that the width and height of the slots 74 and 72 provided in the side members of the bracket are sized and positioned to accommodate the adjoining tabs whether they be the tab pairs 76 or the single tab 70. Also, the positions of the tabs and their associated slots along the side of the brackets are arranged so that they are centered along each half of the bracket side members. In this way, the brackets may be symmetrical when they are connected or turned to form various brick patterns in the finished product.

It is further understood that any type of connector arrangement may be provided along the sides and ends of the brackets which will provide an interlocking connection to hold the individual brackets in proper position when forming the assemblage or patterns as desired.

It is also to be understood that all connectors may be omitted from the outside mating surface of the bracket and the brackets may be positioned adjacent to each other and held or attached to the form by any satisfactory fastening arrangement.

Figure 9:
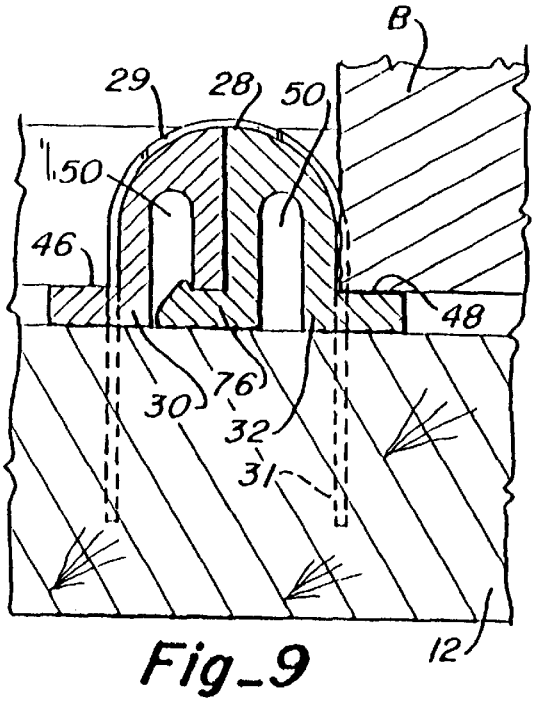
FIG. 9 is a partial cross-section view showing the joint between brackets taken along the lines 9—9 of FIG. 6.
Figure 10:
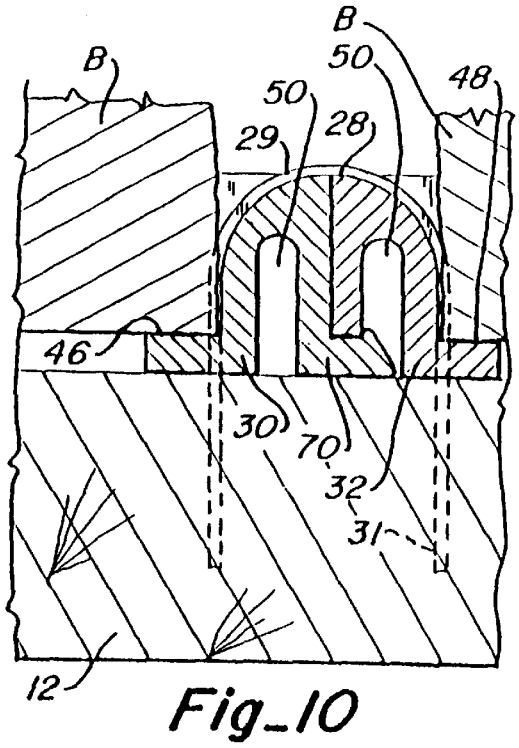
FIG. 10 is a partial cross-section view taken along the lines 10—10 of FIG. 6.
Figure 11:
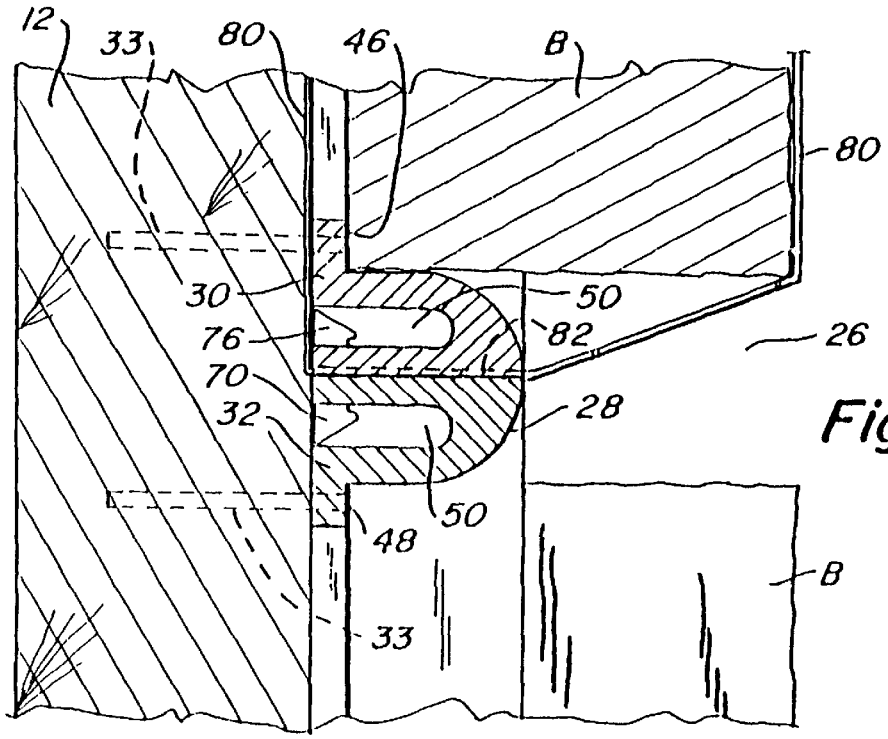
FIG. 11 is a cross-section view taken along the lines 11—11 of FIG. 6 showing the brick removed from the lower recess.

As seen in FIGS. 9, 10 and 11, when the brackets are joined together side by side to form the assemblage 22, the cross-section of the side perimeter members of the two adjacent brackets form a curved ridge 28 between the individual brick pavers. This ridge, as mentioned above, forms a concave grout line in the space 26 between the brick pavers in the finished wall structure. The height of this ridge may be varied to adjust the depth of the grout line in the finished structure.

Protrusions or detentes 89 may be provided along the inside surface of the curved perimeter members. These detentes may be flaps or knobs extending inwardly from the side or end members so that they will contact the opposing side edges of the object. Any number of opposing detentes 89 may be used along the perimeter members to hold and retain the object in the recess. The detentes may be formed as an integral part of the perimeter members of the bracket or may be formed from a separate material and suitably fastened into proper position. The purpose of the detentes is to provide a compression force on opposite sides of the object to securely hold it in place. These mechanical retainers may be provided separately or in combination with adhesives or any other retainer device.

Figure 12:
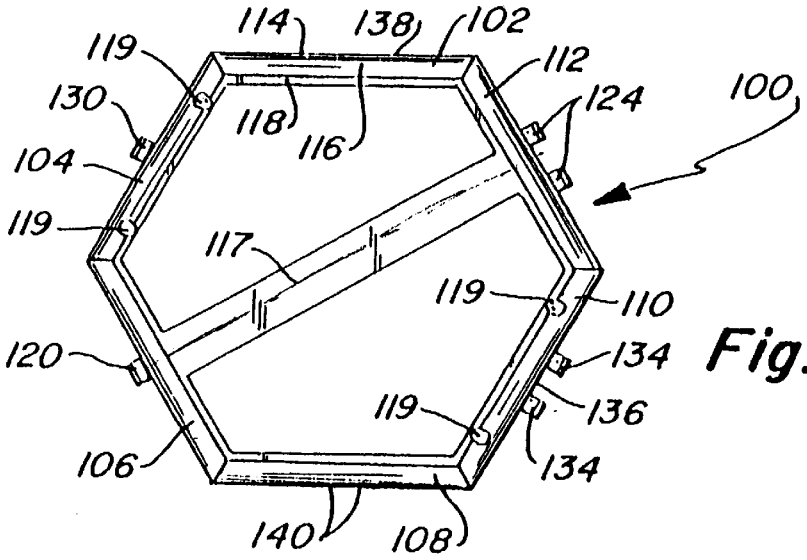
FIG. 12 is a plan view of another embodiment of the retainer bracket according to the present invention showing a hexagon shape.
Figure 13:
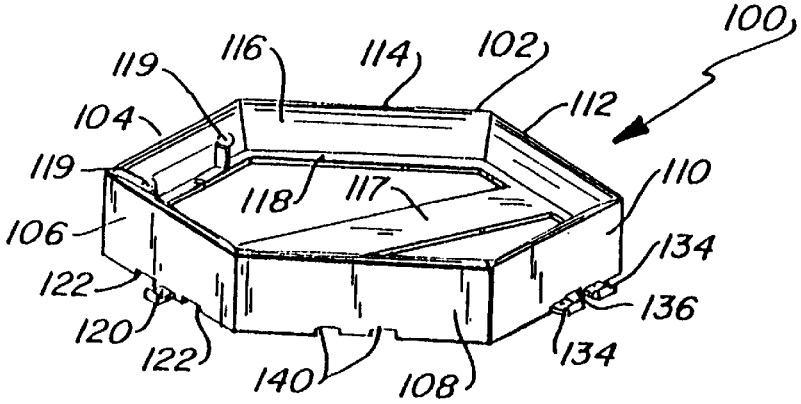
FIG. 13 shows a perspective view of the bracket shown in FIG. 12.

FIGS. 12 and 13 show an alternative embodiment of the object retaining bracket which has been shown and described above. In this configuration the bracket is designed for retaining and supporting a hexagonal tile. Of course, it is to be understood that the object shape may be of any desired configuration so long as the outer perimeter of the bracket itself may be substantially symmetrical. This symmetry is desired, but is not mandatory, in order to allow the brackets to be interconnected into a desired assemblage.

The bracket 100, includes outer side perimeter members 102, 104, 106, 108, 110 and 112. The cross-section of these side perimeter members is essentially the same as those provided and discussed earlier for bracket 24. The side member 102 includes a flat perpendicular outer surface 114 and curved front surface 116. Each of the other side members have a similar surface configuration. The side member 102 also includes an inwardly extending narrow flange or ledge 118 which is used to support and secure the retained object. The width of the flange 118 is sufficient to adequately support and secure the object. This also provides a seal to prevent the concrete and grout mixture from flowing past the curved surface 116 on the side of the object and onto the finished face of the retained object. It is also to be considered that instead of the flange being narrow it can extend partially or completely across the recess portion of the bracket so as to close the central portion of the bracket.

A plurality of detentes or protrusions 1 19 may be formed on the perimeter members so as to extend into the recess and contact the side of the object. These detentes 119 function the same as described in the earlier embodiment. They may be used in pairs diametrically opposed across the bracket. As an alternative, the plurality of detentes need not be diametrically opposed across the bracket but rather, placed according to the retention needs of the object and its application.

As shown in FIGS. 12 and 13, the same configuration is provided as stated above for each of the side members. It is anticipated that, in most cases, there will be an even number of side members to coincide with the outer shape and dimensions of the anticipated retained object. The desirability for the even number of sides is to facilitate the connection of the brackets to form the assemblage. On the other hand, an odd number of side members is possible.

In the six sided hexagonal figure which is shown in FIG. 12, two opposite side members, such as 106, 112 have an interconnecting tab and slot arrangement similar to those which were previously described. Thus, side member 106 along the outer surface includes an outwardly extending tab having an upwardly raised ridge along the outside edge and two equally spaced slots 122. On the opposite member 112 are a pair of outwardly extending tabs 124 also having an upwardly extending ridge along the outer edge of the tabs 124 and between these tabs is positioned a slot which is sized to fit the tab 120 on the opposite number. By the same token, slots 122 are sized to fit the pair of tabs 124 positioned on the opposite side member. Thus, the side member 106 on an adjacent bracket 100 may be positioned next to the side member 112 of the presently described bracket which will interfit and connect together forming the curved upwardly extending ridge for forming the concave grout line in the finished product as previously described. In the same fashion, the side member 104 has a single outwardly extending tab 130 and slots 132 positioned on either side of the tab 130. The opposite side member 110 includes the double outwardly extending tabs 134 and the slot 136 positioned there between.

The remaining two side members 102, 108 do not have any outwardly extending tabs, but do provide accommodating slots 138, 140 which are sized, positioned and arranged to correspond and interfit with a single or double outwardly extending tab arrangement provided on the other side members. This allows these blank side members to receive the tabs from the adjacent positioning of the other brackets within the assemblage. Throughout this description it is understood that any number of side members may be provided where the arrangement is symmetrical so that the brackets will fit together in a close connected assemblage. By the same token, all slots and tabs may be omitted if it is desired to merely position the individual brackets against each other when installing on the inside surface of the form.

This interconnection or positioning of the brackets provides the pattern of the tiles, objects or bricks in the surface of the finished concrete structure. It is also understood that spaces may be left between the individual brackets. Thus, the objects may be positioned randomly across the surface of the structure. A crossmember or tie 117 may be provided to interconnect the flange members on two opposite side perimeter members in order to hold the shape of the bracket relatively rigid. There is enough flexure, however, in the overall structure to allow the bracket to accommodate various sized objects to account for the tolerances which are normally encountered in the manufacture of the objects. This is to say that if the object is slightly larger than standard, the bracket will expand slightly to accommodate a reasonable oversized dimension for the object.

It is also understood that the retaining bracket which is the subject of this application can have a single perimeter member which may be curved to form a closed or partial circular or elliptical configuration. The configuration of the perimeter member and thus, the bracket conforms to the intended object. Whether the member is closed or only partial is determined by the object and the contact retention required for this particular object.

Figure 16:
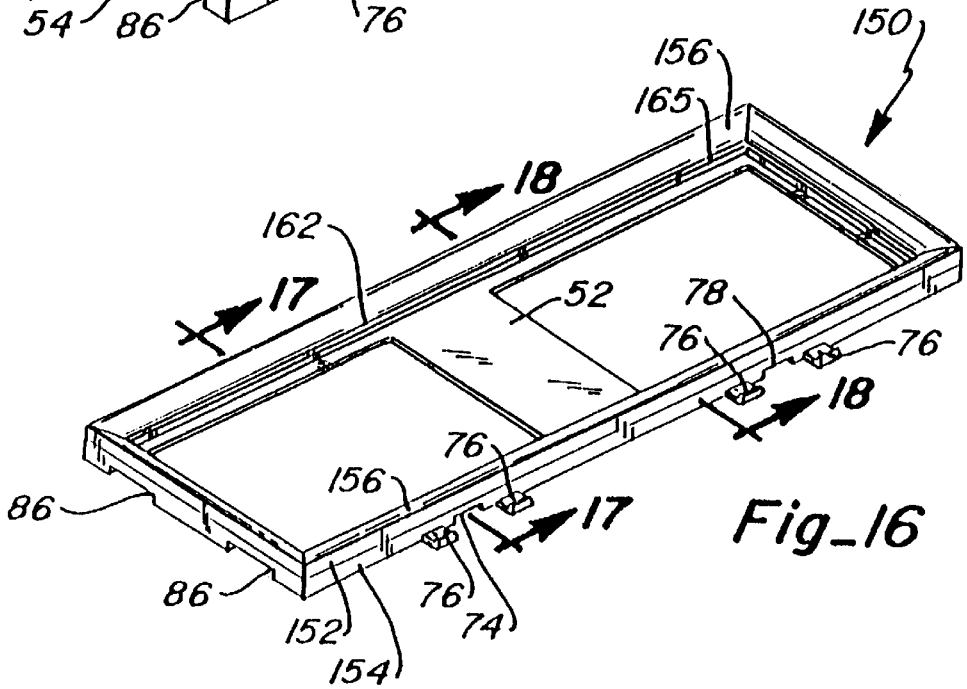
FIG. 16 is a perspective view of another embodiment of the bracket made from a relatively rigid base portion and an elastomeric cap portion.
Figure 17:
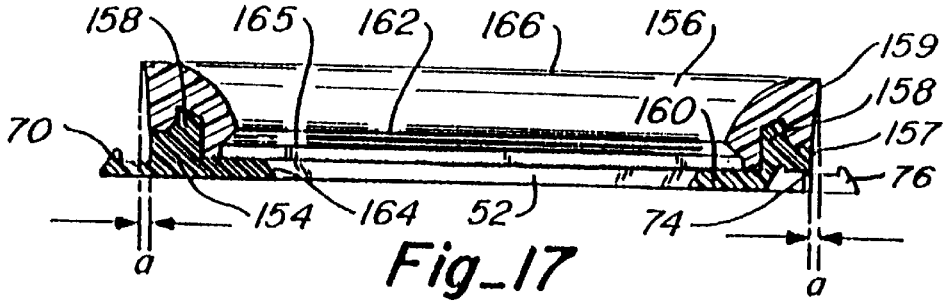
FIG. 17 is a cross-section through lines 17—17 of FIG. 16 showing the composite structure.
Figure 18:
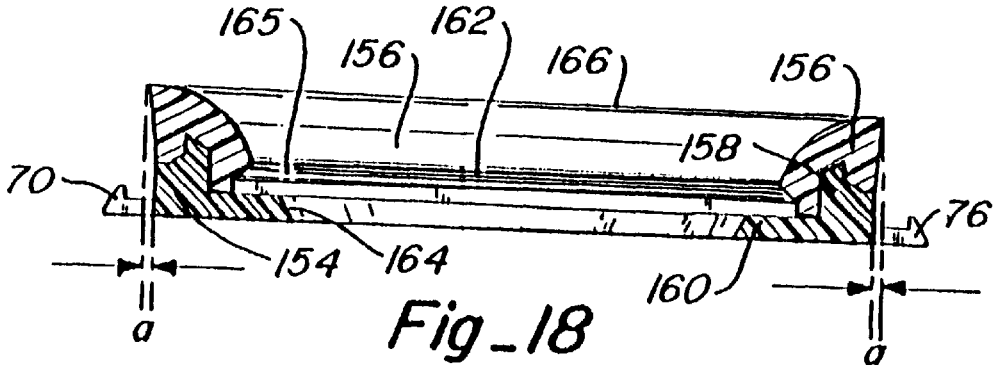
FIG. 18 is a cross-section through lines 18—18 of FIG. 16 showing the composite structure near the mid portion of the bracket.

FIGS. 16–18 illustrate an embodiment of a composite bracket 152, having a base portion 154 and a top perimeter cap portion 156. The base or base portion may be fabricated from a rigid plastic material the same as or similar to the materials described above in the solid material bracket. The cap portion may be fabricated from a resilient elastomeric type polymeric material, such as polyethylene resins, polypropylene resins or polyurethane resins. The latter resin has been found to work quite well for the intended purpose. The bracket itself is formed from the base portion 154 having a flange area 160 and a ridge or key 158. The key 158 can have an upstanding ridge or series of knobs to facilitate the molding and bonding of the resilient material making up the cap portion 156. An outer flat mating surface 157 is included as part of the base portion 154 and provides a rigid contact surface for contact between the adjacent brackets. The upper portion or cap portion 156 is formed or molded from a resilient, elastomeric polymeric material which has some flexibility but is also somewhat rigid. This material is molded as a cap forming the perimeter edge similar to the surfaces shown for the bracket 24 in FIGS. 2 and 3. However, instead of having a flowing curved surface extending upwardly from the interior flange areas to the outer edge the elastomeric material 156 forming the top cap or portion has a flowing rounded surface 155 extending from the outer edge 166 to an inner ridge 162 and then being formed as an undercut returning to the flanged surfaces 160. The reason for the undercut portion is to allow the ridge 162 to extend inwardly toward the recess to form a retaining ridge and seal for securely holding and retaining the object. The knob or key 158 extends above the elevation of the ridge 162 to provide a rigid support behind the ridge area 162. The knob 158 also can have undercut surfaces to facilitate the bonding and retention of the top cap portion 156 to the bottom portion 154. It is also to be understood that any type of ridge surface configuration may be provided in this general area to provide the retaining force for sealing and holding the object within the bracket.

In addition, it is also possible to have a ridge that is only intermittent around the perimeter of the bracket in equal or random lengths to provide the retaining function. A surface treatment may be provided on the outer surface of the ridge area to enhance the gripping and retaining power of the bracket. This surface treatment can be a multiple groove arrangement, such as a serrated edge, extending parallel around the perimeter of the top portion or the outer edge surface of the ridge portion may be of a different material having a different Shore A hardness number. This could be a difference in the primary material or could be a separate insert imbedded in the surface of the cap portion.

Figure 19:
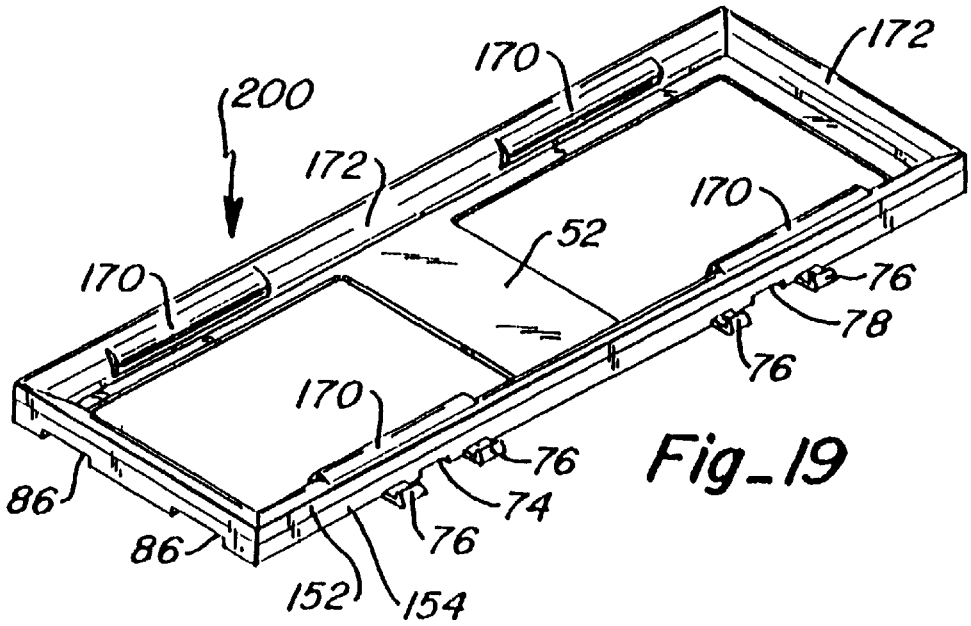
FIG. 19 is a perspective view showing ridge sections in the elastomeric cap portion of this embodiment.

The outer surface 159 of the cap portion 154 may be molded so that the top edge 166 extends slightly outward from the flat mating surface 157 of the base portion 154. The purpose of this outer extension of the upper portion of the cap portion is to allow the surface 159 to abut against an adjacent bracket, causing the two surfaces to slightly compress forming a seal between the surfaces of the resilient materials of the brackets. This outward extension is shown as Dimension a in FIG. 17. Dimension a can actually vary from 0 to 0.125 inches or more, depending upon the amount of compression desired for sealing purposes. Through experimentation, it is found that just 0.005 inches is sufficient to provide a relatively adequate seal. FIGS. 17 and 18 show a cross-section of the composite bracket made up of the base portion 154 and the top cap portion 152. The difference between these figures is the cross-section of the tabs and slots which have been disclosed as one way of providing the connectors for attaching the brackets together in any design or assemblage. FIG. 19 reveals an embodiment of the disclosed composite bracket having intermittent sections of the ridge portion 170 extending inwardly from a curved surface 172 which provides the molded concave grout line along with the ridge sections 170. This embodiment is provided to illustrate the various modifications which may be applied to the bracket and the perimeter surface and still be considered part of the present invention.

Figure 15:
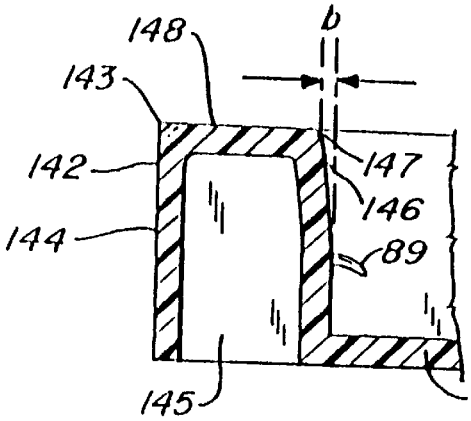
FIG. 15 is a cross-section taken along the lines 15—15 of FIG. 14 showing the rectangular configuration to form a rake type grout line.
Figure 14:
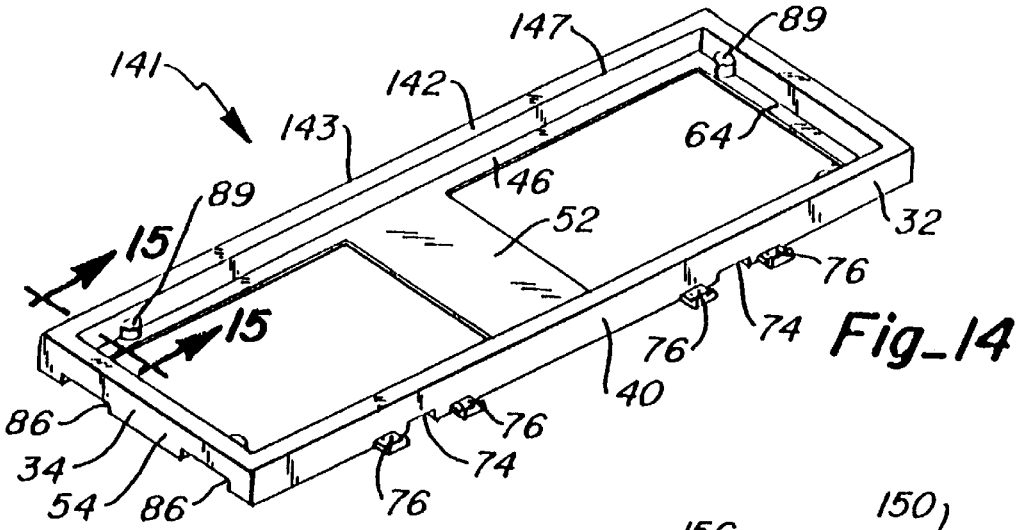
FIG. 14 is a partial cross-section view of a bracket having a rectangular perimeter member and detentes positioned randomly along the inside edge of the perimeter member of the bracket.

FIG. 14 shows another embodiment of the bracket 24 which is illustrated in FIGS. 2 and 3. The bracket 141 has a modified perimeter cross-section which produces a so called rake grout line in the finished wall surface. The rake grout line is one that has a generally flat surface recessed below the outer surface of the bricks or objects. FIG. 15 is a general cross-section of the perimeter of the bracket 141 showing the outer flat surface 144 joining in a sharp corner edge 143 to a relatively right angled top surface 148. The top surface 148 is joined in either a sharp or curved edge 147 blending into a slightly curved and downward surface 146 which joins to the flange 46. For the purpose of flexure between the wall surfaces 146 and 144 a void 145 may be provided between these surfaces in order to provide flexure in the bracket perimeter to be able to slightly adjust to the variance in the dimensions of the brick or objects due to the tolerances of manufacturing these items. The surface 146 can taper outwardly to provide a slight bevel, having a width of Dimension b to provide clearance between the surface 146 and the object. This tapering of the surface 146 permits easy removal of the bracket from the embedded object when the bracket and form are removed. Additional tensioning may be provided by detentes 89 which may be positioned either in opposing pairs or randomly around the inside surface of the perimeter in order to contact the object and to assist in retaining the object within the bracket 141. The taper on the surface 146 may be as little as five thousandths of an inch up to any dimension which is desired and still provide the desired profile and form for the grout line to be produced in the finished structure.

Again, it is to be noted that any of the disclosed brackets may be arranged to have any number of sides and perimeter shape which is required for fitting the desired object and purpose. This invention is not to be limited in any way by the overall shape, size or configuration of the object.

In using the composite bracket 150, it is believed that the necessity for using extra devices for securing the object in the bracket will be unnecessary. It may be desirable, however, since no additional finish, such as wax coating, will be required on the face of the brick or object, a "retarder paper" cut to follow the interior dimensions of the recess may be inserted in the bottom portion of the bracket before the insertion of the object. In this way, as a backup, the surface of the object may be kept uncontaminated, even if a small amount of leakage of the grout from the concrete actually seeps past the retaining elastomeric ridge.

A critical area of this invention is the attachment of the object, such as the brick paver or tile, to the bracket so that it is rigidly secured until such time as the bracket is stripped away from the embedded object retained within the surface of the concrete structure. One technique which may be used with the single material bracket is an adhesive for securely attaching the object to the flange portion of the bracket and to seal the perimeter edge of the object to the bracket to prevent leakage of concrete between the bracket and the finished face of the object. For the composite brackets, the resilient cap portion forms a gasket-like seal around the outside edge of the object. This gasket then performs the dual purpose of holding the object in place and sealing the perimeter edge of the object preventing leakage of the concrete onto the finished face of the object.

It is the intent of the inventors to use an adhesive or device that will allow the bracket to be subsequently released from the face of the object when the form is stripped. The adhesive may be in the form of a water soluble glue, such as an organic vegetable adhesive or a suitable wax type adhesive having a paraffin base. With a water soluble type glue or adhesive, when it is time for the form to be stripped from the surface of the concrete, spraying water between the form and the finished concrete face will loosen the retention of the bracket to the object and allow the form to be easily stripped from the structure. It has been found that "Dextrine" liquid adhesive manufactured by H. B. Fuller Company is a suitable adhesive for this purpose. In the same way, a hot water or hot air stream may be applied where the adhesive is a paraffin base type wax. In this arrangement, the wax will melt from the increased temperature allowing the form to be removed.

It is also possible to provide other types of adhesives, such as those which may be softened by solvents or a type of adhesive that has a relatively low retention rate that may be pulled away from the finished surface by applying sufficient breakaway force. Hot glue applied by use of an electric glue gun G, has been found to work very well, and may be used to secure the pavers or other objects to the bracket, as well as to secure the bracket and pavers to the inside surface of the form. Hot glue also may be used to secure the pavers or other objects to elastomeric liners or to the form itself. It is also possible to use an elastic retainer, similar to an elastic band or rubber band 80 which is shown in FIG. 11, to either retain the object in position on the bracket or to aid in the retention of the object. The elastic band may be used by itself or in conjunction with the adhesive or other retainers for retaining the object. It is possible that a narrow, shallow slot 82 may be provided along the outside flat surfaces of the side members 30, 34 of the bracket 24 to accommodate an elastic band 80, if desired. It has also been found that a slot may not be necessary since the elastic band 80 may be squeezed between the surfaces of the brackets. In this configuration, when the form and brackets are removed from the surface of the finished structure, the elastic bands will readily separate and withdraw into the surface of the finished concrete making them virtually invisible.

The brackets may be fabricated from any suitable material, such as polypropylene, polyvinyl chloride (PVC) or high impact polystyrene. High impact polystyrene (HIP), available through Monsanto Chemical Corporation has been found to be quite suitable for this type of structure. In the composite bracket, the base portion may be made from the same material as listed above. The cap portion may be fabricated from a resilient, elastomeric synthetic polymeric material, such as polyethylene resins, polypropylene resins or polyurethane resins. The latter has been found to work quite well for this purpose. The selected material needs to be pliable but yet rigid to retain the object and provide a seal when required. A material having a Shore A hardness from approximately 10 to 50 will be satisfactory.

It is also to be understood throughout this application that the object retainer bracket as described herein can also be used in the forming of structures utilizing other types of settable medium, such as plaster or various types of settable plastics. The purpose of the individual bracket provided in the present invention is to allow an individual object along with any number of additional objects to be securely retained in a form to hold or retain the object while the construction medium is poured into the form or cast and which will allow the object to be firmly embedded in the surface of the finished structure or product.

Throughout this application the cross-section of the perimeter members of the retaining bracket has been illustrated and described as being an upwardly and outwardly curved surface so that when joined together with an adjacent bracket a grout line will be formed in the finished surface having a smooth concave surface. It is intended that this is a best mode disclosure but that the invention is not limited to this configuration. The cross-section of the perimeter numbers of the bracket holder can have any configuration desired, such as rectangular, square, diamond shaped, oval, etc. The shape and dimensions of the cross-section of the perimeter member of the retaining bracket which extends from the flange area to the mating surface of the edge forms one half of a mold which establishes the width, depth and shape of the grout line between the objects.

Figures 20, 21:
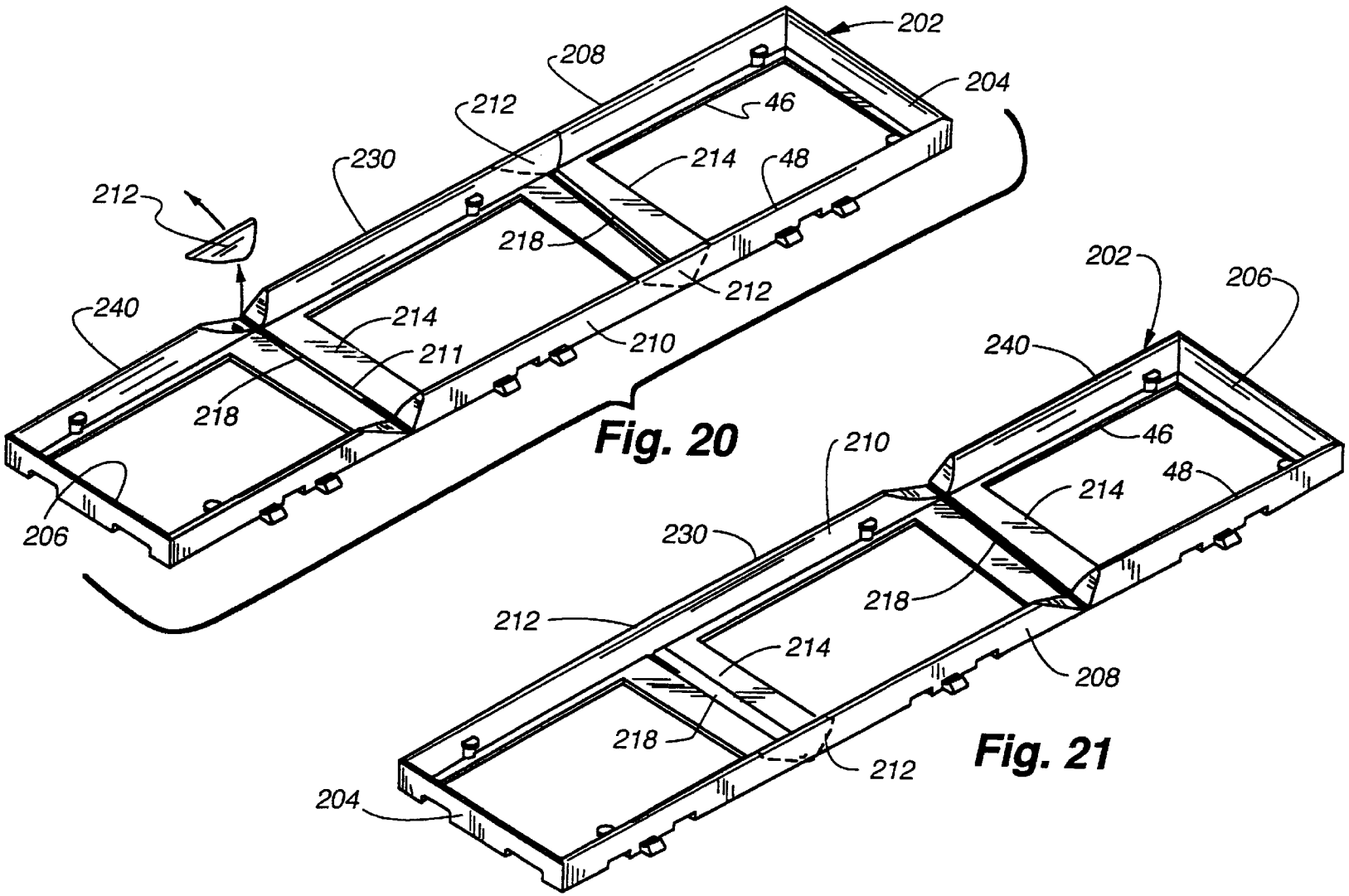
FIG. 20 is a perspective view of a corner bracket illustrating the removable tabs.
FIG. 21 is a reverse view of the bracket shown in FIG. 20.

FIGS. 20–24 show an alternative preferred embodiment of the present invention. As shown in FIGS. 20 and 21 a corner bracket 202 comprises end perimeter members 204 and 206 and side perimeter members 208 and 210. The difference in the views shown in FIG. 20 and FIG. 21 is that the corner bracket 202 in FIG. 21 is rotated 180 degrees about a vertical axis from the orientation of the corner bracket 202 in FIG. 20. The corner bracket 202 may be constructed in similar fashion as bracket 24 illustrated in FIGS. 2 and 3. Tab 212 is integrated into side perimeter members 208 and 210 at opposing positions. Side perimeter members 208 and 210 may be scored or partially cut to define tab or axial point 212. Tab 212 may be easily removed by the application of pliers or similar tools, yet is sufficiently secured to bracket 202 to resist inadvertent dislocation. It should be noted that in FIGS. 20 and 21, the inside surfaces of the side and end members 204, 206 are flat instead of rounded so as to form a V-Shaped grout line in the finished concrete. This flat surface is illustrated by the straight lines depicting the inside surface lines at the missing tabs.

Figure 22:
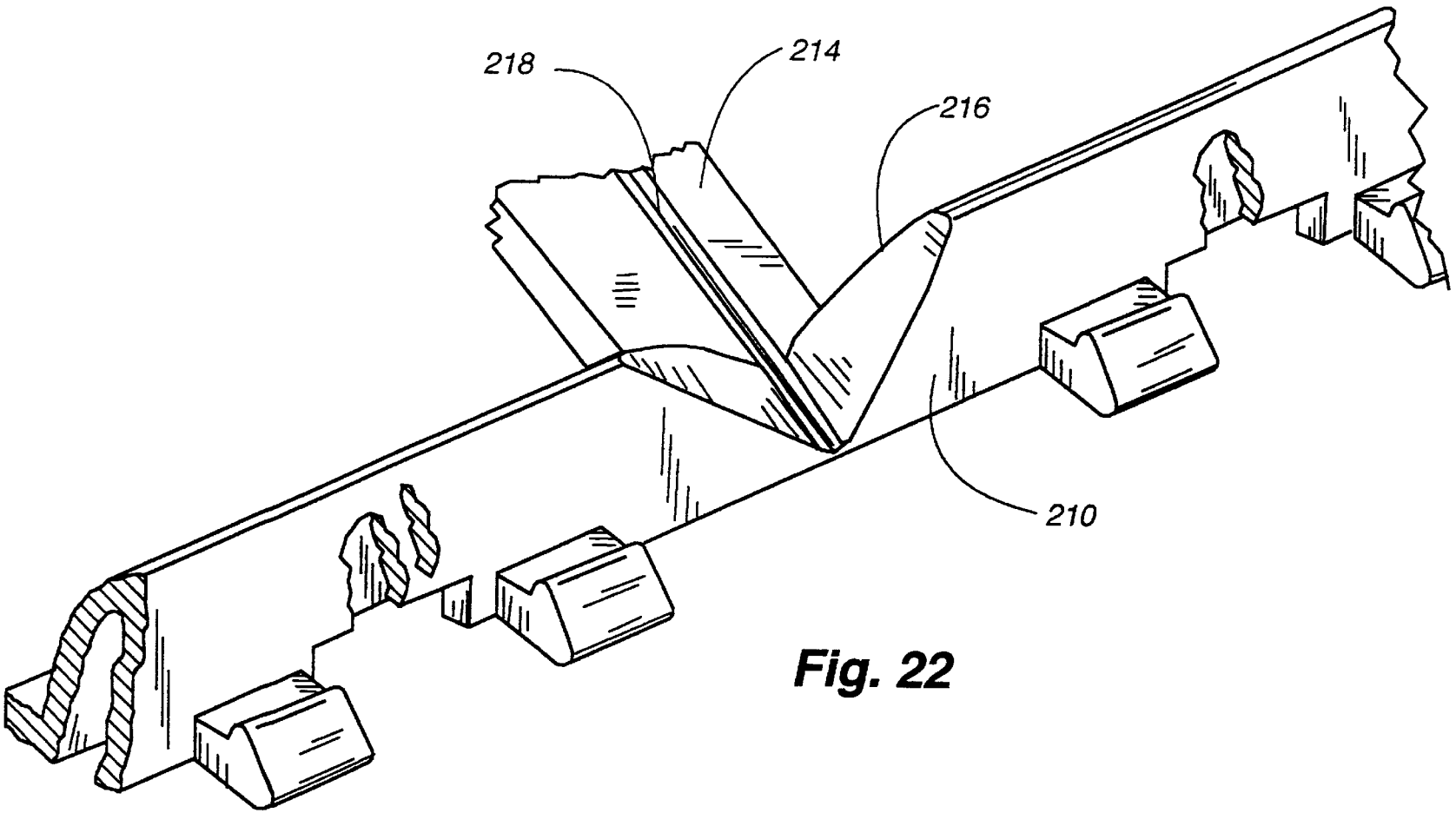
FIG. 22 is a partial cross section view of one side of the corner bracket.

FIG. 22 show side perimeter member 210 with tab 212 removed. Sufficient material remains beneath the void created by the removal of tab 212 to allow side perimeter member 210 to hinge 211 at the point from where tab 212 was removed.

The crossmember 214 spans the cavity of the corner bracket 202 and connects the flange surfaces 46 and 48. Crossmember 214 may include a groove or axial bold line 218 at the center of the crossmember 214 that runs the length of crossmember 214 and parallel to end perimeter members 204 and 206. As shown in FIG. 22, the crossmember 214 may be placed adjacent to opposing removable tabs 212. When the tabs 212 are removed, the crossmember 214 and corner bracket 202 may hinge 211 at the groove 218, and the crossmember 214 may provide support to sections 230 and 240.

Figure 23:
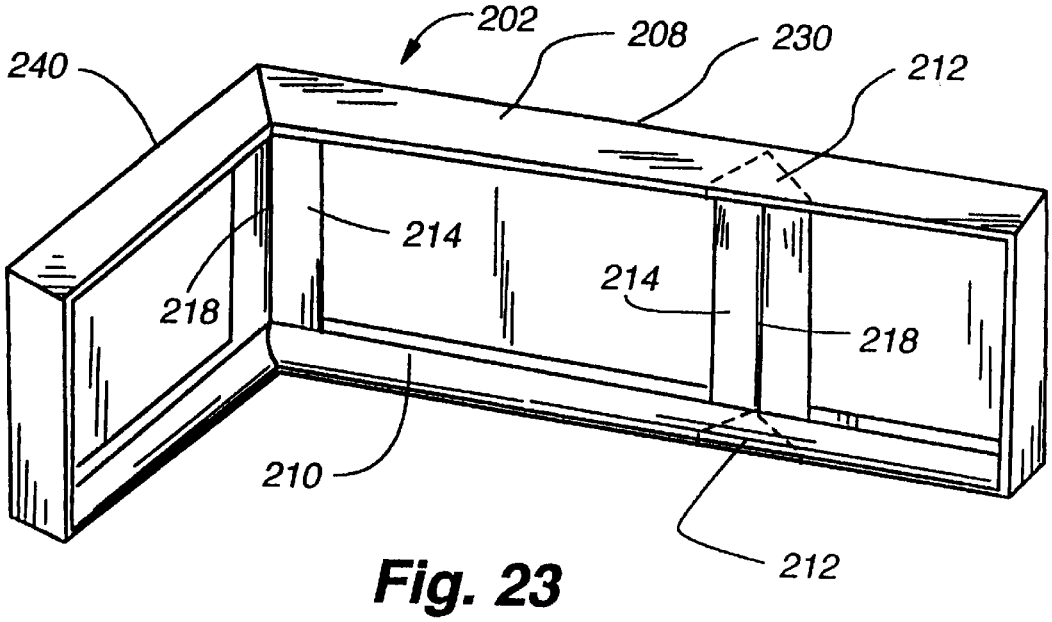
FIG. 23 is a perspective view of the bracket shown in FIG. 20 after it has been bent to fit in a corner of a form.

As shown in FIG. 23, when the tabs 212 are removed from side perimeter members 208 and 210, the bracket 202 is divided into two attached sections 230 and 240 that allow the bracket 202 to be rotated to a desired angle about parallel, axial points on side perimeter members 208 and 210. The removable tabs 212 may be placed at a plurality of locations to allow the corner bracket 202 to be placed around a corner at the left edge of the surface or around a corner at the right edge of the surface.

To facilitate the placement of the corner bracket 202 around a corner at either the left edge of a surface or the right edge of a surface, the crossmember 214 may be located between adjacent removable tabs 212 located approximately one third of the length of side perimeter members 208 and 210 from perimeter end member 204, as well as from perimeter end member 206. Preferably, section 230 defines the area of a standard brick paver and section 240 defines the area of a standard brick paver in half across the narrow dimension of the brick's face. A standard size brick paver, tile, or other object may be fastened to an inner surface of a form wall by section 230, the corner bracket 202 may be placed around the corner of the form wall and the partial or half-sized brick paver, tile, or other object may be attached by section 240 to the adjoining form wall. Once the concrete or other'settable material is poured and the form walls and brackets are removed, the appearance of traditional masonry construction is achieved. By placing the tabs 212 and crossmember 214 at different locations along side perimeter members 208 and 210 and providing different dimensions for sections 230 and 240, brick pavers or other objects having various dimensions may also be attached at the corner of adjoining walls to simulate traditional masonry construction.

Figure 24:
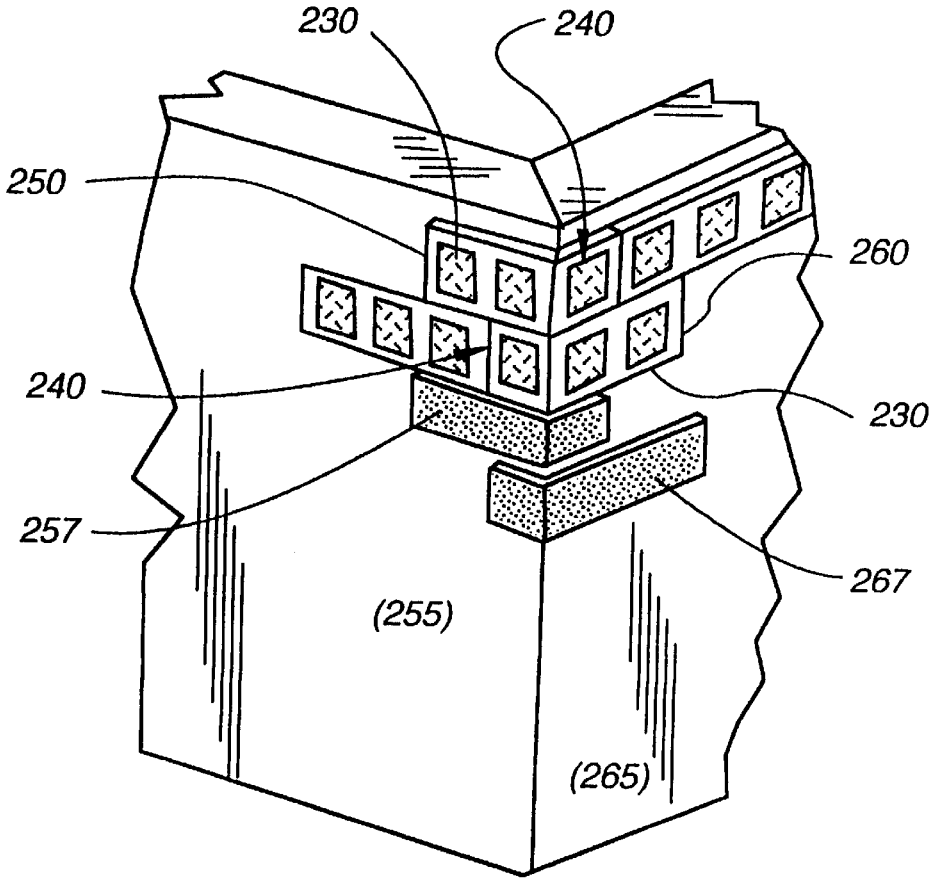
FIG. 24 is a partial perspective view showing the use of corner brackets to embed brick pavers or other objects in a corner of a structure.

FIG. 24 illustrates the corner bracket 202 applied at the outside corner of two adjoining surfaces. The form has been removed showing the brackets and some embedded objects. At position 250, the corner bracket 202 is applied to the corner at the right edge of surface 255. At position 250, the tabs 212 have been removed to allow section 230 to be attached to surface 255, thus positioning a brick paver, tile, or similar object at the right edge of surface 255. Corner bracket 202 is bent around the corner to allow section 240 to attach another brick paver, tile, or other object at the left edge of surface 265, thus achieving the appearance of a full sized brick or other object as shown at position 257. The objects themselves can have a miter joint or can overlap, as desired.

At position 260, the corner bracket 202 is applied to the corner at the left edge of surface 265. At position 260, the tabs 212 have been removed to allow section 230 to be attached to surface 265, thus positioning a brick paver, tile, or similar object at the left edge of surface 265. Corner bracket 202 is bent around the corner to allow section 240 to attach another brick paver, tile, or other object at the right edge of surface 255, thus achieving the appearance of a full sized brick or other object as shown at position 267.

Corner bracket 202 may be constructed from composite material similar to the composite material described above in the discussion of composite bracket 150. The composite material may either be scored to define tab 212, thus allowing removal of tab 212 by the use of pliers, or tab 212 may be cut away from the side perimeter member with a commonly available tool such as a utility knife or any other suitable cutting tool.

FIGS. 25 through 31 illustrate an alternate preferred embodiment of a retaining bracket. Bracket 300 connects to detachable members which allow different configurations to accommodate brick pavers, tiles, or other objects of different shapes. Bracket 300 may attach objects in a substantially parallel relationship to the inside of a concrete form, or may be configured to attach two objects placed in a substantially perpendicular relationship to the inside of a form to fit the objects around the corner of a wall or structure, thus creating the appearance of a cornerstone in a conventional masonry wall. A single, angled or "L" shaped paver may also be attached by bracket 300 to the inside of a form to create the cornerstone effect.

The bracket 300 also may be used to attach a paver having been cut to a desired length to the edge of a form. Often, when a brick paver, tile, or other object is placed at the edge of a wall, it must be cut to an exact length to fit between the adjacent object and the edge of the wall. The bracket 300 may be cut to accommodate the desired length, and may use either a corner piece 320 to accommodate corner configurations or an end piece 340 to accommodate the customized single brick paver, tile, or other object.

Figure 25:
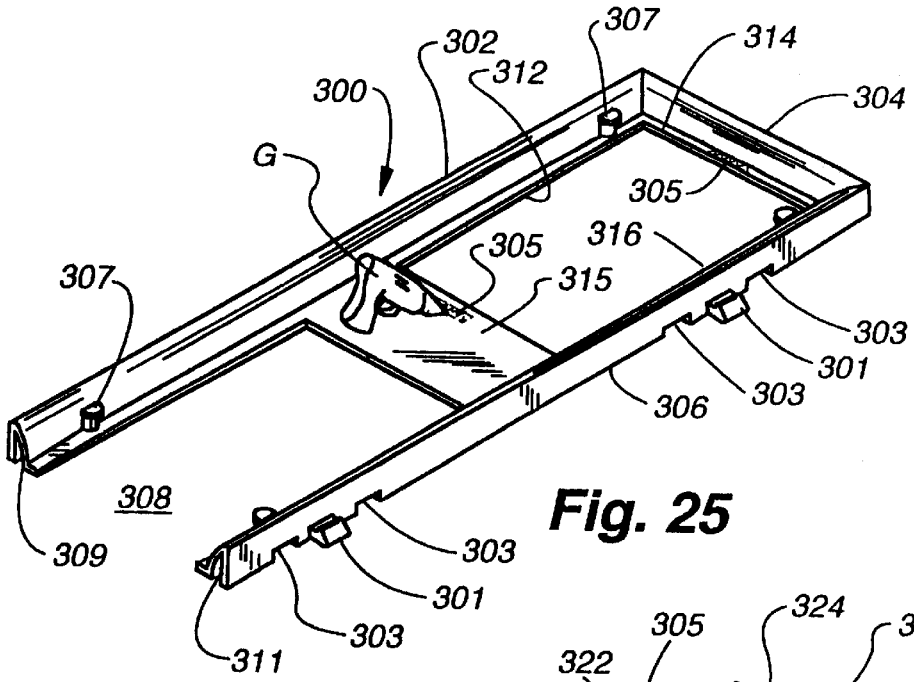
FIG. 25 is a perspective view showing a shortened retaining bracket.

Directing attention to FIG. 25, the bracket 300 comprises and end perimeter member 304 and side perimeter members 302 and 306. Flanged surfaces 312, 314, and 316 are attached to the interior edges of perimeter members 302, 304, and 306, respectively. The flanged surfaces 312, 314, and 316 form a mating surface to receive the brick paver, tile, or other object to be attached to the form surface. A crossmember 315 provides support to the bracket 300 by spanning the cavity of the bracket 300 between the side perimeter members 302 and 316 and connecting the flange surfaces 312 and 316. End 308, located opposite the end perimeter member 304, facilitates the attachment of either the corner piece 320 or the end piece 340. Channels 309 and 311 span the length of the side perimeter members 302 and 306, respectively, in a manner similar to the channels shown on the back side of the corner piece 320 in FIG. 27. As shown in FIG. 25, the channels 309 and 311 are exposed at end 308 to receive the mating tabs protruding from the corner piece 320 and the end piece 340. The length of the bracket 300 may be shortened to a desired dimension by cutting the side perimeter members 302 and 306 with a utility knife or other suitable cutting tool.

Figure 26:
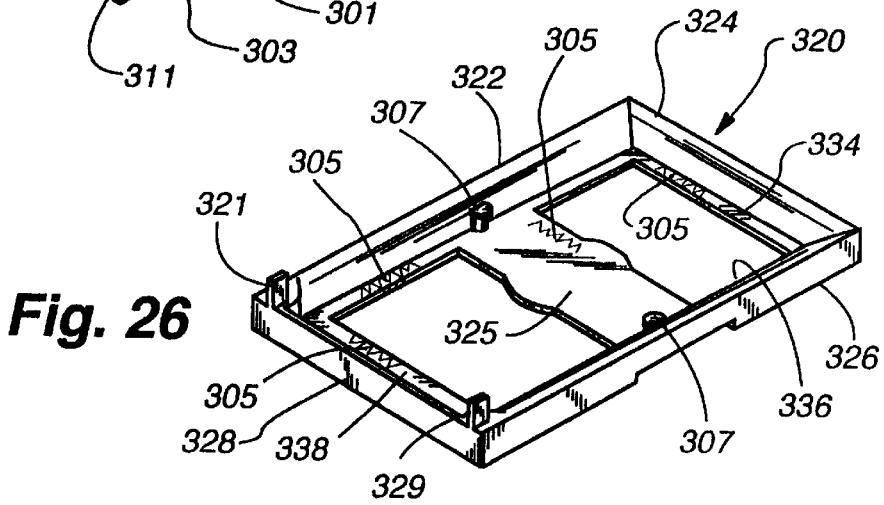
FIG. 26 is a perspective view showing the complimentary corner piece that can attach to the cut end of the bracket shown in FIG. 25 to create a corner bracket.
Figure 27:
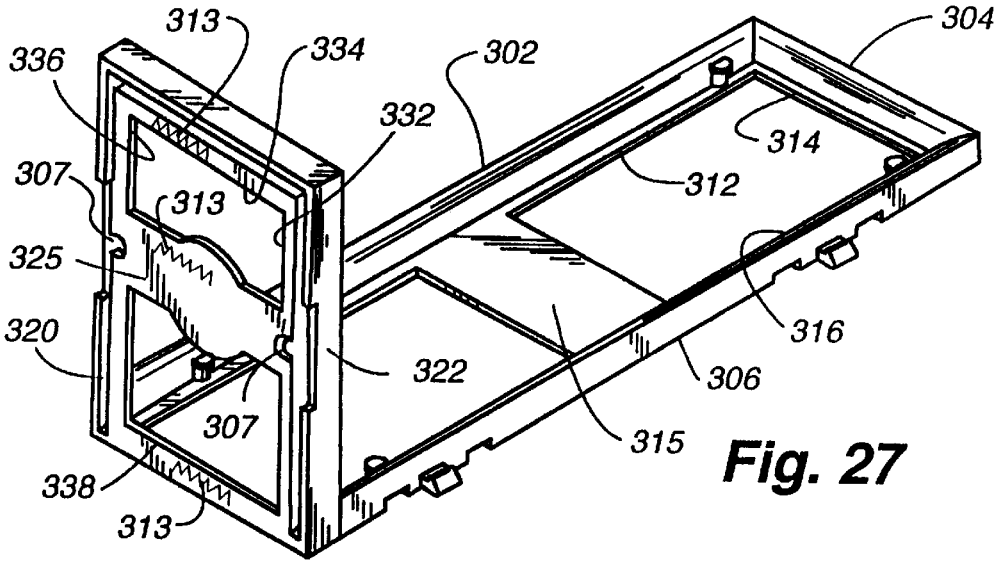
FIG. 27 is a perspective view showing the retaining bracket of FIG. 25 attached to the corner piece of FIG. 26 to create an integral corner bracket.
Figure 28:
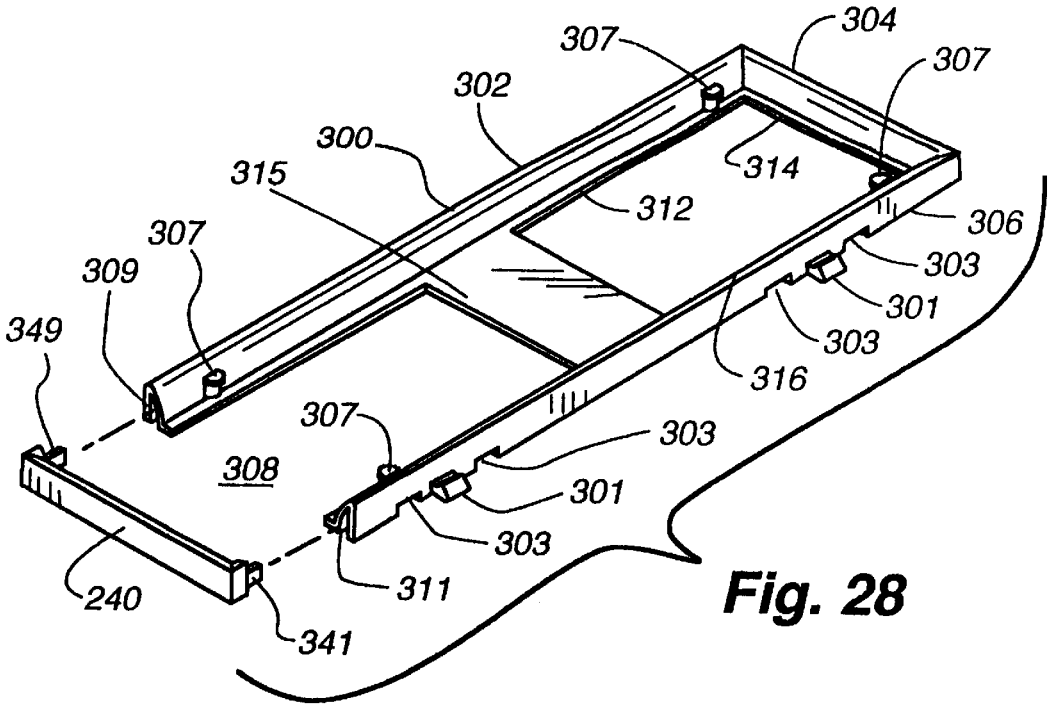
FIG. 28 is an exploded perspective view showing the bracket of FIG. 25 and an end closure piece.
Figure 29:
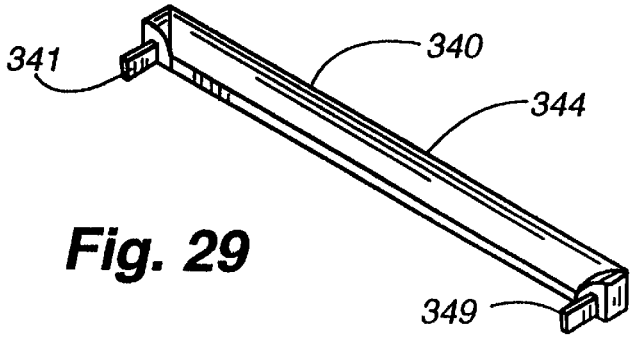
FIG. 29 is a perspective view of the end closure piece that attaches to the bracket of FIG. 25.
Figure 30:
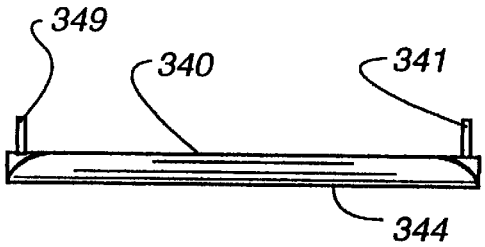
FIG. 30 is a plan view showing the end closure piece.
Figure 31:
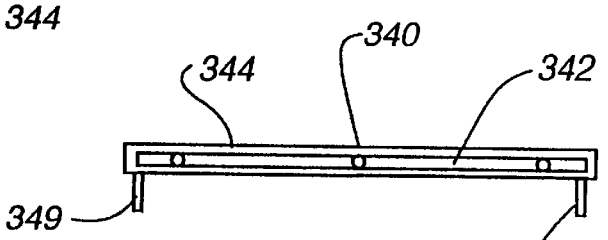
FIG. 31 is a plan view showing the underside of the end closure piece.

FIG. 26 shows a perspective view of the corner piece 320. The corner piece 320 is constructed in a manner similar to the bracket 300. The corner piece 300 comprises end perimeter members 324 and 328, and side perimeter members 322 and 326. Flanged surfaces 332, 334, 336 and 338 are attached to the interior edges of perimeter members 322, 324, 326, and 328, respectively. The flanged surfaces 332, 334, 336, and 338 form a mating surface to receive the brick paver, tile, or other object to be attached to the wall surface. A crossmember 325 provides support to the corner piece 320 by spanning the cavity of the corner piece 320 between side perimeter members 322 and 326 and connecting the flange surfaces 332 and 336. Corner piece 320 can incorporate mating tabs 321 and 329 for attaching the corner piece 320 to the bracket 300 in a substantially perpendicular relationship, as shown in FIG. 27. As shown in FIG. 26, the mating tabs 321 and 329 are integrated into the end perimeter member 328 and protrude from the end perimeter member 328 in a substantially perpendicular manner. To connect the corner piece 320 to the bracket 300, the mating tabs 321 and 329 are inserted into channels 311 and 309, respectively, at end 308. When the corner piece 320 is attached to the bracket 300, a brick paver, tile, or other object may be fastened to the inside surface of a form by the bracket 300, and the corner piece 320 may be placed around the corner of the form to attach another brick paver, tile, or other object to the adjoining surface of the form. Once the concrete or other settable material is poured into the mold and the form and brackets are removed, the appearance of traditional masonry construction is achieved. The combination of bracket 300 and corner piece 320 can attach a pair of brick pavers, tiles, or other objects around a corner of two adjoining surfaces, but can also attach a single, angled brick paver, tile, or other object specifically designed to fit around a corner. The bracket 300 and corner piece 320 can attach to adjoining surfaces in a similar manner as the corner bracket 202 shown in FIG. 24.

End piece 340 is shown in FIGS. 28 through 31. End piece 340 is constructed in a similar manner as end perimeter member 304 on bracket 300, and attaches to bracket 300 at end 308. Mating tabs 341 and 349 can be integrated into the end perimeter member 344 and protrude from end member 344 in a substantially perpendicular manner. To connect the end piece 340 to the bracket 300, the mating tabs 341 and 349 are inserted into channels 311 and 309, respectively, at end 308. A suitable glue or adhesive applied by a "hot glue" gun G can be used to secure the tabs. After end piece 340 is connected to the bracket 300, a brick paver, tile, or other object may be secured to an inner surface of a form wall. By cutting side perimeter members 302 and 306 before the end piece 340 is connected, bracket 300 may be shortened to a desired dimension. By interlocking the tabs 301 located on side perimeter member 306 with the slots 303, a plurality of brackets 300 may be connected on the inside surface of a form to form a desired pattern.

The bracket 300, corner piece 320, and end piece 340 may be fabricated from any suitable material, such as polypropylene or polyvinyl chloride (PVC). High impact polystyrene (HIP), available through Monsanto Chemical Corporation, has also been found to be a suitable material.

The bracket 300 may be secured to the form by adhesives or by driving staples or tacks through or around the perimeter numbers provided on both the bracket 300 and the corner piece 320, or elsewhere on the flanges 312, 314, 316, 332, 334, 336, or 338. In addition, adhesives as previously described may be used to secure the brackets to the forms.

When adhesive is used to adhere the object to the bracket 300 or corner piece 320, the adhesive may be applied to any of the surface of the flanges 312, 314, 316 or crossmember 315 as shown at locations 305 in FIG. 25 and flanges 332, 334, 336, 338 or crossmember 325 in FIG. 26. To use adhesive to secure the corner piece 320 to a form, the adhesive may be applied to the underside of the flanges 332, 334, 336 and 338 or crossmember 325 as shown at locations 313 in FIG. 27. Adhesive may be applied in a similar manner to the underside of the bracket 300 to attach the bracket 300 to the surface of a form.

It has been found that a "hot glue" gun G can be used quite successfully to adhere the object to the bracket and the bracket to the form. In fact, a small "dab" of the hot glue placed at strategic locations on the object and bracket provides just enough "holding" to accomplish the purpose of the bracket. The object is securely held in the bracket while the settable material, such as concrete is poured into the form cavity, while the bracket and form are quickly released from the embedded object to perform the intended function. While various types of "hot melt" glue are available, the common type of low heat sensitive glue has been found to be satisfactory. An added benefit is that heat in the form of hot water or hot air can be used in the stripping of the brackets and form from the structure to help in releasing the glue or adhesive to leave less residue or contamination on the surface of the finished structure.

While an improved object retaining bracket for use in a construction form has been shown and described in detail in this application, it is to be understood that this invention is not to be limited to the exact form disclosed and changes in detail and construction of the various embodiments of the invention may be made without departing from the spirit thereof.

What is claimed is:

1. A corner bracket for retaining a first object having a face surface with perimeter edges and a second object having a face surface with perimeter edges, said bracket capable of being arranged to place said first object at an angle in relation to said second object so as to form a corner in proper position on an inside surface of a form for a structure while a settable material is poured into the form to harden and embed the objects with their face surfaces exposed in the surface of the finished structure, the face surface of each of said objects having a perimeter edge configuration, said bracket comprising:

a) two side perimeter members, said side perimeter members being arranged to conform to the outer configuration of said perimeter edges of said first object and said perimeter edges of said second object and to form a recess there between for receiving said first and second objects, each of said side perimeter members includes an outer mating surface located on an opposite side of the perimeter member from the recess and each of said side perimeter members has opposite ends;

b) flanged members attached to said side perimeter members, said flanged members and said side perimeter members contacting and supporting said first and second objects;

c) one or more fixed axial points located on each of said side perimeter members whereby the side members may be folded so that said first and second objects are positioned at an angle with respect to each other to form a corner; and d) an extended surface which extends from each of the flanged members and joins the mating surface along an outer edge of said side perimeter members, said extended surface comprising a mold shaped to form a joint line in the settable material between two objects when their corresponding brackets are positioned adjacent to each other.

2. A corner retaining bracket as defined in claim 1 wherein said bracket further comprises at least one pair of removable tabs, at least one tab being formed in each of the side perimeter members at a location corresponding to said axial points.

3. A corner retaining bracket as defined in claim 2 wherein said fixed axial points and said removable tabs are located on said side perimeter members so that the corresponding tabs can be removed so that said side members may be folded around said axial points to form a corner.

4. A corner retaining bracket as defined in claim 2 wherein at least two of said axial points and said removable tabs are located on each of said side perimeter members so that the bracket can be folded in one of two different locations so that the bracket can form either a right corner or a left corner as desired.

5. A corner retaining bracket as defined in claim 3 wherein said side perimeter members are scored to define said removable tabs.

6. A corner retaining bracket as defined in claim 1 wherein said extended surface comprises an outwardly and upwardly curved surface which extends from said flanged members and joins the mating surface.

7. A corner retaining bracket as defined in claim 6 wherein said curved surface is curved to form one half of a concave grout line between said objects.

8. A corner retaining bracket as defined in claim 1 wherein said extended surface is flat to form one half of a "V" shaped grout line between said objects.

9. A corner retaining bracket as defined in claim 1 wherein said extended surface is squared to form one half of a flat shaped grout line between said object.

10. A corner retaining bracket as defined in claim 1 further including end perimeter members having flanged areas, said end perimeter members joined with the ends of said side perimeter members to form a closed continuous perimeter configuration.

11. A corner retaining bracket as defined in claim 10 wherein the perimeter configuration is in the shape of a rectangle.

12. A corner retaining bracket as defined in claim 1 wherein the bracket includes two perimeter members which are arranged substantially parallel and a crossmember extends between the two side members to provide rigidity and support to the bracket.

13. A corner retaining bracket as defined in claim 1 wherein said objects are portions of a brick and said bracket further comprises coupling means for attaching a plurality of similar brackets together while forming a corner so that said brackets can be attached to a corner of adjoining form surfaces to represent a desired brick pattern on the surface of a finished structure.

14. A corner retaining bracket as defined in claim 1 which further includes one or more crossmembers, said crossmembers spanning a distance between said side perimeter members and attaching to said flange members so as to support said side perimeter members.

15. A bracket for retaining a first object having a face surface with perimeter edges and a second object having a face surface with perimeter edges, said bracket being arranged to place said first object at an angle in relation to said second object so as to form a corner in proper position on an inside surface of a form for a structure while a settable material is poured into the form to harden and embed the objects with their face surfaces exposed in the surface of the furnished structure, the face surfaces of said objects having perimeter edge configurations, said bracket comprising:

a) a first section, said first section comprising:

1) two spaced apart side perimeter members, said perimeter members having opposite ends, said side perimeter members arranged to conform to the outer configuration of said perimeter edges of said first object and to form a recess therebetween for receiving said first object;

2) flanged members attached to said side perimeter members extend inwardly toward each other, said flanged members and said side perimeter members contacting and supporting said first object;

3) one or more crossmembers, said crossmembers spanning a distance between said side perimeter members and attaching to said flanged members so as to support said side perimeter members;

b) a second section, said second section comprising:

1) two spaced apart side perimeter members, said side perimeter members having opposite ends, said side perimeter members arranged to conform to the outer configuration of said perimeter edges of said second object and to form a recess there between for receiving said second object; and c) connecting means for connecting an end of each of the side perimeter members of said second section to an end of each of side perimeter members of said first section so as to form an angular corner relationship.

16. A bracket as defined in claim 15, wherein said connecting means comprises hollow interior channels in each of said perimeter members of said first section, said channels running the length of said perimeter members of said first section.

17. A bracket as defined in claim 16 wherein said connecting means comprises a mating means, said mating means protruding in a substantially perpendicular relationship from the ends of said second section, said mating means being arranged to be inserted into said channels so as to connect the sections together in a generally right angle corner configuration.

18. A bracket for retaining an object having a face surface with a perimeter edge, said bracket being arranged to retain the object in proper position on the inside surface of a form for a structure while a settable material is poured into the form to harden and embed the object with the face surface exposed in the surface of the finished structure, said bracket comprising:

a) two side perimeter members, said side perimeter members being arranged to conform to the outer configuration of said perimeter edges of the object and to form a recess there between for receiving said object, said perimeter members including flanged members which extend inwardly towards each other across said recess and laying in a common plane so that the flanged members and the side members contact and support the object, said perimeter members include a mating surface on the outside of said perimeter members away from said flanged members and substantially perpendicular to the plane of said flanged member, each of said perimeter members having opposite ends; and b) end members attached to and connecting the corresponding ends of said perimeter members, at least one of said end members having a connecting means whereby the perimeter members ray be cut to any desired length and said at least one end member having the connecting means may be connected to the cut end of the side perimeter members, the respective side perimeter members and the respective end members being sized to fit the perimeter edges of said object.

19. A retaining bracket as defined in claim 18 wherein the side perimeter members include elongated hollow channels running substantially the length of said perimeter members and the connecting means includes a tab formed at each end of the at least one end member whereby the tabs fit and connect to the channel formed in each perimeter member to close the recess between the side perimeter members and conform the bracket to the configuration of the object.

* * * * *